US009737134B2

(12) United States Patent
Moskovich et al.

(10) Patent No.: US 9,737,134 B2
(45) Date of Patent: Aug. 22, 2017

(54) ORAL CARE IMPLEMENT HAVING FLEXIBLE HANDLE

(75) Inventors: Robert Moskovich, East Brunswick, NJ (US); Thomas Mintel, Rahway, NJ (US); Andreas Wechsler, Zell am See (AT); Douglas Hohlbein, Hopewell, NJ (US); Jan Felix Muller, Weil der Stadt (AT); Alan Sorrentino, Cranbury, NJ (US); Al Sprosta, Maplewood, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 289 days.

(21) Appl. No.: 14/385,288

(22) PCT Filed: Mar. 22, 2012

(86) PCT No.: PCT/US2012/030114

§ 371 (c)(1),
(2), (4) Date: Sep. 15, 2014

(87) PCT Pub. No.: WO2013/141860

PCT Pub. Date: Sep. 26, 2013

(65) Prior Publication Data

US 2015/0033485 A1 Feb. 5, 2015

(51) Int. Cl.
*A46B 5/00* (2006.01)
*A46B 5/02* (2006.01)

(52) U.S. Cl.
CPC ..... *A46B 5/0066* (2013.01); *A46B 5/0037* (2013.01); *A46B 5/0058* (2013.01);
(Continued)

(58) Field of Classification Search
CPC ..... A46B 5/00; A46B 5/002; A46B 5/0033; A46B 5/0037; A46B 5/0041;
(Continued)

(56) References Cited

U.S. PATENT DOCUMENTS 1,632,859 A 6/1927 Straehly
1,968,303 A 7/1934 McMath
(Continued)

FOREIGN PATENT DOCUMENTS

CN 201238726 5/2009
DE 20109123 5/2001
(Continued)

OTHER PUBLICATIONS

International Search Report and the Written Opinion issued in International Application PCT/US2012/30114 mailed Dec. 10, 2012. WO.

(Continued)

*Primary Examiner* — Mark Spisich

(57) ABSTRACT

An oral care implement having a flexible handle. In one embodiment, the invention can be an oral care implement comprising: a head; and a handle extending along a longitudinal axis and connected to the head, the handle comprising: a main body integrally formed of a rigid material, the main body comprising a rigid gripping section terminating in a bulbous body, a rigid neck section terminating in a basin, and a flexible strut having a first end connected to the bulbous body and a second end connected to a floor of the basin; a resilient material encasing the flexible strut; and the flexible strut and the resilient material forming a hinge about which the rigid neck section pivots relative to the rigid gripping section upon a force being applied to the head.

69 Claims, 17 Drawing Sheets

(52) U.S. Cl.
CPC ..... *A46B 5/0062* (2013.01); *A46B 5/0091* (2013.01); *A46B 5/02* (2013.01); *A46B 5/026* (2013.01); *A46B 2200/1066* (2013.01)

(58) Field of Classification Search
CPC ... A46B 5/0045; A46B 5/0054; A46B 5/0058; A46B 5/0062; A46B 5/0066; A46B 5/007; A46B 5/0091; A46B 5/02; A46B 5/021; A46B 5/026; A46B 5/06; A46B 9/04; A46B 2200/1066
USPC ..... 15/143.1, 144.1, 144.2, 167.1, 172
See application file for complete search history.

(56) References Cited

U.S. PATENT DOCUMENTS

| | | | | |
|---|---|---|---|---|
| 2,263,802 | A | 11/1941 | Grusin | |
| 3,398,421 | A | 8/1968 | Rashbaum | |
| 4,020,521 | A | 5/1977 | Velasquez | |
| 4,403,623 | A | 9/1983 | Mark | |
| 4,520,526 | A | 6/1985 | Peters | |
| 4,633,542 | A | 1/1987 | Taravel | |
| 4,654,922 | A | 4/1987 | Chen | |
| 4,796,325 | A | 1/1989 | Bortman | |
| 5,052,071 | A | 10/1991 | Halm | |
| 5,054,154 | A | 10/1991 | Schiffer et al. | |
| 5,228,166 | A | 7/1993 | Gomez | |
| 5,394,584 | A | 3/1995 | Breitschmid | |
| 5,491,866 | A | 2/1996 | Simonds | |
| 5,511,277 | A | 4/1996 | Simonds | |
| 5,524,319 | A | 6/1996 | Avidor | |
| 5,630,244 | A | 5/1997 | Chang | |
| 5,735,012 | A | 4/1998 | Heinzelman et al. | |
| 5,802,656 | A | 9/1998 | Dawson et al. | |
| 5,839,149 | A | 11/1998 | Scheier et al. | |
| 5,884,354 | A | 3/1999 | Anderson | |
| 5,898,967 | A | 5/1999 | Wu et al. | |
| 5,956,797 | A | 9/1999 | Wilson | |
| 5,987,689 | A | 11/1999 | Gordon | |
| 6,006,395 | A | 12/1999 | Tiramani et al. | |
| 6,066,282 | A | 5/2000 | Kramer | |
| 6,101,659 | A | 8/2000 | Halm | |
| 6,327,735 | B1 | 12/2001 | Kramer | |
| 6,408,473 | B1 | 6/2002 | Kessler | |
| 6,668,416 | B1 | 12/2003 | Georgi et al. | |
| 6,779,851 | B2 | 8/2004 | Bouchiere | |
| 6,883,200 | B1 | 4/2005 | Euler | |
| 6,931,688 | B2 | 8/2005 | Moskovich et al. | |
| 6,972,106 | B2 * | 12/2005 | Huber | A46B 5/02 264/243 |
| 6,988,777 | B2 | 1/2006 | Pfenniger et al. | |
| 6,990,706 | B2 | 1/2006 | Broecker et al. | |
| 7,020,928 | B2 | 4/2006 | Hohlbein | |
| 7,162,767 | B2 | 1/2007 | Pfenniger et al. | |
| 7,275,277 | B2 | 10/2007 | Moskovich et al. | |
| 7,383,619 | B2 | 6/2008 | Gross et al. | |
| 7,480,955 | B2 | 1/2009 | Hohlbein et al. | |
| 7,574,765 | B2 | 8/2009 | Huber et al. | |
| 7,614,111 | B2 | 11/2009 | Moskovich et al. | |
| 7,805,796 | B2 | 10/2010 | Winter et al. | |
| 7,841,041 | B2 | 11/2010 | Moskovich et al. | |
| 2001/0013151 | A1 | 8/2001 | Gelder et al. | |
| 2002/0056197 | A1 | 5/2002 | Johnson | |
| 2005/0015907 | A1 | 1/2005 | Georgi et al. | |
| 2006/0195995 | A1 | 9/2006 | Moskovich et al. | |
| 2007/0204417 | A1 | 9/2007 | Russell et al. | |
| 2007/0271717 | A1 | 11/2007 | Clos et al. | |
| 2007/0283519 | A1 | 12/2007 | Moss | |
| 2008/0086827 | A1 | 4/2008 | Waguespack et al. | |
| 2008/0147104 | A1 | 6/2008 | Gatzemeyer et al. | |
| 2008/0235889 | A1 | 10/2008 | Lary | |
| 2009/0025165 | A1 | 1/2009 | Moskovich et al. | |
| 2009/0091178 | A1 | 4/2009 | Waguespack et al. | |
| 2010/0058550 | A1 * | 3/2010 | Ballmaier | A46B 5/02 15/167.1 |
| 2010/0092916 | A1 | 4/2010 | Teixeira et al. | |
| 2010/0313371 | A1 | 12/2010 | Kaczmarek | |
| 2011/0016651 | A1 | 1/2011 | Piserchio | |
| 2011/0138563 | A1 | 6/2011 | Phgura | |
| 2011/0152909 | A1 | 6/2011 | Jimenez et al. | |
| 2011/0271471 | A1 | 11/2011 | Kirsh | |

FOREIGN PATENT DOCUMENTS

| | | | |
|---|---|---|---|
| DE | 202005009026 | | 6/2005 |
| DE | 102006025825 | | 6/2006 |
| EP | 0613636 | | 9/1994 |
| EP | 1532891 | | 5/2005 |
| EP | 2 292 118 | | 3/2011 |
| GB | 2413268 | | 10/2005 |
| WO | WO 93/15627 | | 8/1993 |
| WO | 99/39610 | * | 8/1999 |
| WO | WO 01/43582 | | 6/2001 |
| WO | WO 2007 051203 | | 5/2007 |
| WO | WO 2008 093300 | | 8/2008 |
| WO | WO 2008 103597 | | 8/2008 |

OTHER PUBLICATIONS

Written Opinion of the International Preliminary Examining Authority issued in International Application PCT/US2012/30114 mailed Jun. 5, 2014. WO.

* cited by examiner

ORAL CARE IMPLEMENT HAVING FLEXIBLE HANDLE

CROSS-REFERENCE TO RELATED PATENT APPLICATIONS

The present application is a U.S. national stage entry under 35 U.S.C. §371 of Patent Cooperation Treaty Patent Application No. PCT/US2012/30114, filed Mar. 22, 2012, the entirety of which is incorporated herein by reference.

FIELD OF THE INVENTION

The present invention relates generally to oral care implements, and specifically to oral care implements, such as toothbrushes, having flexible handles.

BACKGROUND OF THE INVENTION

Toothbrushes that incorporate flexibility into the handle and/or the head are known in the art. Such flexibility can be used to deter a toothbrush user from exerting too great of a force on the user's teeth during toothbrushing. Conventional toothbrushes that offer flexibility are often formed from multiple components that are mechanically coupled together. Due to the requirement to form such toothbrushes from multiple components, manufacturing costs are increased. Furthermore, in conventional toothbrushes that offer flexibility, the amount of flexibility is either limited due to the shape of the components or breakage occurs when the toothbrush is flexed beyond a certain point. Thus, a need exists for an improved toothbrush having a flexible handle.

BRIEF SUMMARY OF THE INVENTION

The present invention is directed to an oral care implement. In one aspect, the oral care implement can include a handle and a head. The handle can be formed of a rigid gripping section, a rigid neck section and a hinge section extending between and connecting the rigid gripping section to the rigid neck section. The hinge section can include a flexible strut. In some embodiments, a resilient material encases the flexible strut of the hinge section.

In one embodiment, the invention can be an oral care implement comprising: a handle extending along a longitudinal axis and comprising a rigid gripping section, a rigid neck section, and a hinge flexibly connecting the rigid neck section to the rigid gripping section, wherein one of the rigid neck section or the rigid gripping section comprises a bulbous body and the other one of the rigid neck section or the rigid gripping section comprises a basin; the hinge comprising: the bulbous body; the basin; a longitudinal strut of rigid material, the longitudinal strut having a first end connected to the bulbous body and a second end connected to a floor of the basin so that a separation gap exists between the bulbous body and the floor of the basin; and a resilient material in the separation gap; and a head connected to the rigid neck section of the handle.

In another embodiment, the invention can be an oral care implement comprising: a head; and a handle extending along a longitudinal axis and connected to the head, the handle comprising: a main body integrally formed of a rigid material, the main body comprising a first rigid longitudinal section terminating in a bulbous body, a second rigid longitudinal section terminating in a basin, and a longitudinal strut having a first end connected to the bulbous body and a second end connected to a floor of the basin; a resilient material encasing the flexible strut; and the longitudinal strut and the resilient material forming a hinge about which the second rigid longitudinal section pivots relative to the first rigid longitudinal section upon a force being applied to the head.

In yet another embodiment, the invention can be an oral care implement comprising: a head comprising a front surface and a rear surface; a plurality of teeth cleaning elements extending from the head; a handle connected to the head, the handle extending along a longitudinal axis and comprising a first rigid longitudinal section, a second rigid longitudinal section, and a hinge about which the second longitudinal section pivots relative to the first longitudinal section upon a force being applied to the head; the hinge comprising: a bulbous body of the first rigid longitudinal section; a basin of the second rigid longitudinal section, the basin formed by first and second longitudinal flanges that extend axially from a floor of the basin, the first and second longitudinal flanges being circumferentially spaced apart from one another by a first valley circumferentially aligned with a rear surface of the head; and a resilient material in a separation gap between the bulbous body and the floor of the basin that connects the first and second rigid longitudinal sections together.

In a further embodiment, the invention can be an oral care implement comprising: a head; a handle extending along a longitudinal axis and connected to the head, the handle comprising: a main body integrally formed of a rigid material, the main body comprising a rigid gripping section terminating in a first transverse shoulder, a rigid neck section terminating in a second transverse shoulder, and a longitudinal strut having a first end connected to the first transverse shoulder and a second end connected to the second transverse shoulder; a separation gap between the rigid gripping section and the rigid neck section; a first flexure limiting block protruding from the first transverse shoulder into the separation gap; a second flexure limiting block protruding from the second transverse shoulder into the separation gap, the first and second flexure limiting blocks circumferentially aligned with one another and a rear surface of the head so that a flexure limiting gap is formed between the first and second flexure limiting blocks; and a resilient material in the separation gap and in the flexure limiting gap; and the longitudinal strut and the resilient material forming a hinge about which the rigid neck section pivots relative to the rigid gripping section upon a force being applied to the head.

In a still further embodiment, the invention can be an oral care implement comprising: a head; a handle extending along a longitudinal axis and connected to the head, the handle comprising: a main body integrally formed of a rigid material, the main body comprising a rigid gripping section terminating in a first transverse shoulder, a rigid neck section terminating in a second transverse shoulder, a first strut, and a second strut oriented obliquely to the first strut; a separation gap between the rigid neck section and the rigid gripping section' a resilient material in the separation gap; and the first strut, the second strut, and the resilient material forming a hinge pivotably coupling the rigid neck section and the rigid gripping section together.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
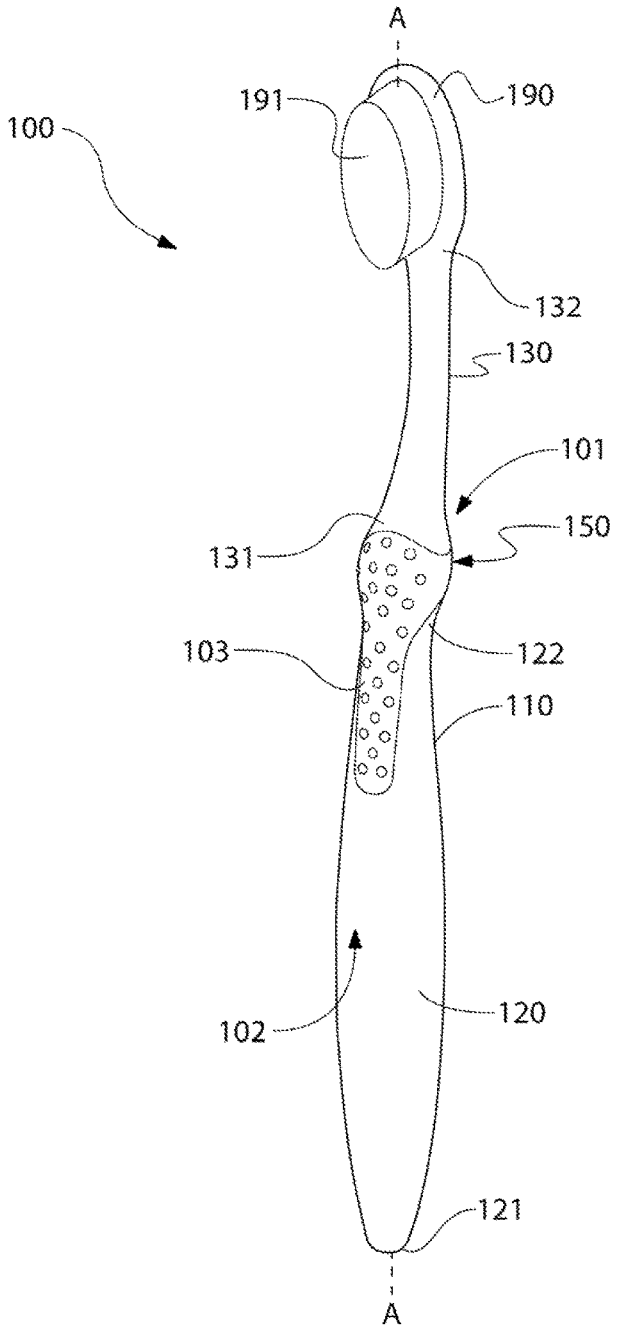
FIG. 1 is a front perspective view of an oral care implement in accordance with a first embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of the exemplary embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the exemplary embodiments illustrated herein. Accordingly, the invention expressly should not be limited to such exemplary embodiments, even if indicated as being preferred. The discussion herein describes and illustrates some possible non-limiting combinations of features that may exist alone or in other combinations of features. The scope of the invention is defined by the claims appended hereto.

Figure 2:
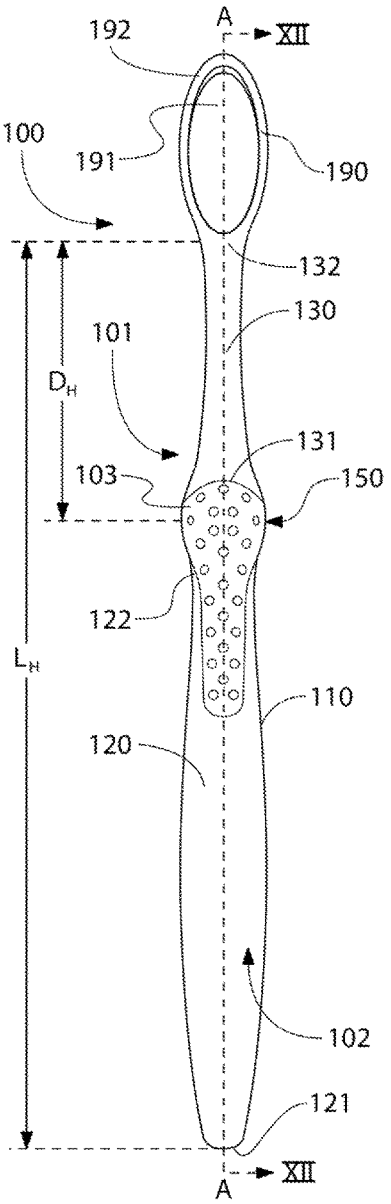
FIG. 2 is a front view of the oral care implement of FIG. 1.
Figure 3:
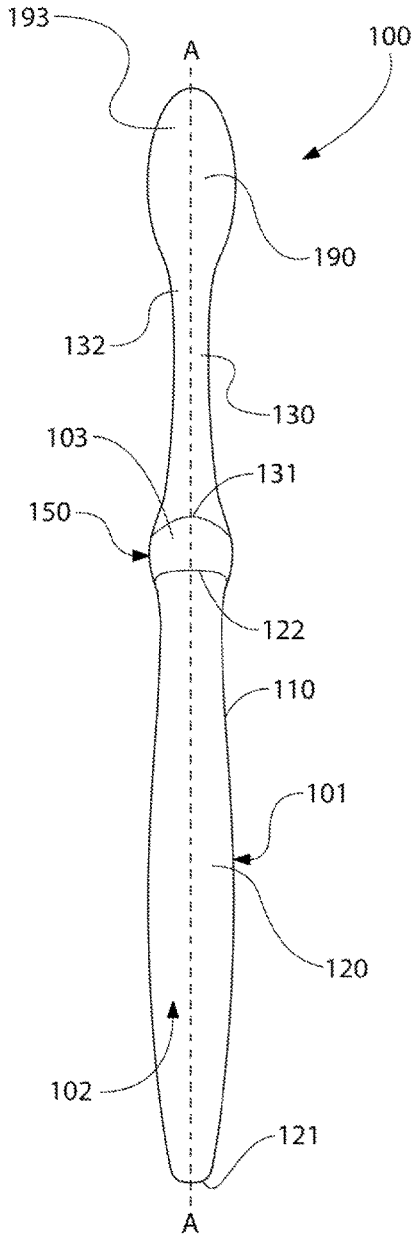
FIG. 3 is a rear view of the oral care implement of FIG. 1.

Referring to FIGS. 1-3 concurrently, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as being a powered toothbrush, a flossing device, a tongue scraper, a gum and soft tissue cleaner, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement 100 generally comprises a handle 110 and a head 190. The head 190 comprises a front surface 192 and an opposing rear surface 193 and a plurality of tooth cleaning elements 191 extending from the head 190 beyond the front surface 192. In the exemplified embodiment, the tooth cleaning elements 191 are generically illustrated. The exact number, size and configuration of the tooth cleaning elements 191 are not to be limiting of the present invention unless so specified in the claims. The tooth cleaning elements 191 can be particularly suited for brushing teeth, or can be particularly suited to polish teeth instead of or in addition to cleaning teeth. Although not illustrated, a tissue cleanser in the form of nubs or protrusions could be positioned on and protrude beyond the rear surface 193 of the head 190.

As used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 191 of the present invention can be connected to the head 190 in any manner known in the art. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

The handle 110 extends along a longitudinal axis A-A and is connected to the head 190. In the exemplary embodiment, the head 190 and the handle 110 are integrally formed as a single unitary structure using a molding, milling, machining or other suitable process. However, in other embodiments the handle 110 and the head 190 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Whether the head 190 and the handle 110 are of a unitary or multi-piece construction (including connection techniques) is not limiting of the present invention, unless specifically claimed. In some embodiments of the invention, the head 190 may be detachable (and replaceable) from the handle 110 using techniques known in the art.

In the exemplified embodiment, the head 190 has a generally oval shape. However, the invention is not to be limited by the shape or contour of the head 190 unless so specified in the claims. Thus, the head 190 and the tooth cleaning elements 191 are generically illustrated herein, but those generic illustrations are not intended to limit the present invention.

Referring to FIGS. 1-4B concurrently, the oral care implement 100 will be further described. The handle 110 comprises a main body 101 that is integrally formed of a rigid material. The main body 101 comprises a first rigid longitudinal section 120, a second rigid longitudinal section 130 and a hinge 150. In the exemplified embodiment, the first rigid longitudinal section 120 is a rigid gripping section of the main body 101 and the second rigid longitudinal section 130 is a rigid neck section of the main body 101. The hinge 150 is a portion of the handle 110 that is longitudinally positioned between the first rigid longitudinal section 120 (i.e., the rigid gripping section) and the second rigid longitudinal section 130 (i.e., the rigid neck section). The hinge 150 facilitates a pivoting or flexing motion of the handle 110. Specifically, the hinge 150 forms a portion of the handle 110 about which the second rigid longitudinal section 130 pivots relative to the first rigid longitudinal section 120 upon application of a force $F_1$ to the head 190. Thus, during brushing or any other activity that imparts the force $F_1$ to the head 190 in a direction normal to the longitudinal axis A-A, the second rigid longitudinal section 130 will flex and pivot about the hinge 150 in the direction of the force $F_1$. This pivoting movement will be described in greater detail below with specific reference to FIGS. 13A-13C.

Figure 4A:
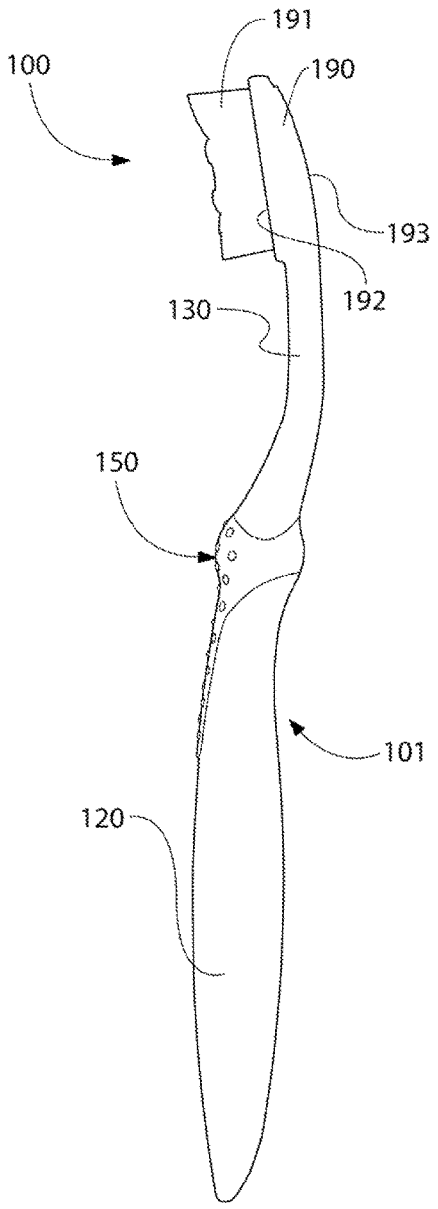
FIG. 4A is a side view of the oral care implement of FIG. 1 in a biased position.
Figure 4B:
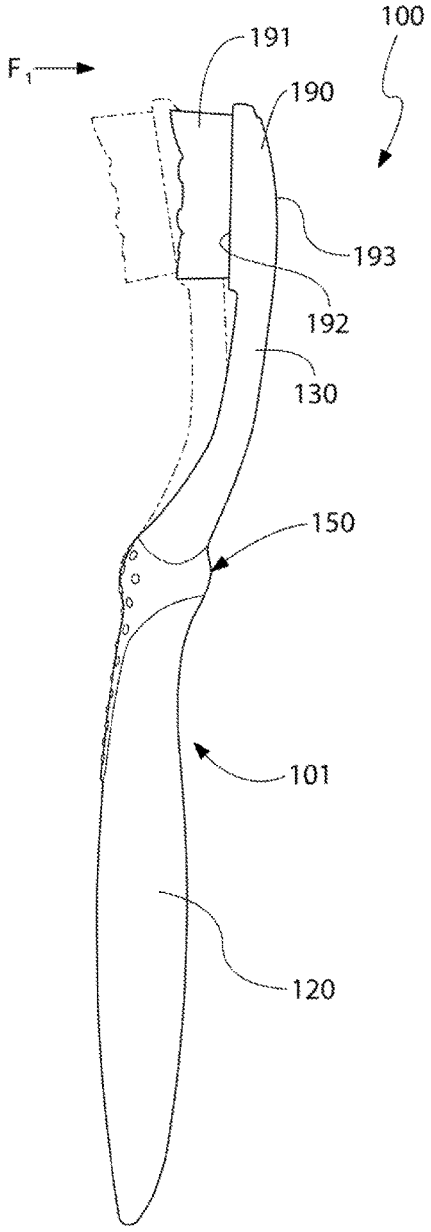
FIG. 4B is a side view of the oral care implement of FIG. 1 with a force being applied to the head.

FIG. 4A illustrates a side view of the oral care implement 100 in its biased position when there is no force acting on the head 190. In the biased position, the second rigid longitudinal section 130 is substantially coaxial with the first rigid longitudinal section 120. FIG. 4B illustrates a side view of the oral care implement 100 while the force $F_1$ is being applied to the head 190. When the force $F_1$ is applied to the head 190, the second rigid longitudinal section 130 pivots in the direction of the rear surface of the head 193 so as to achieve an acute angle relative to the first rigid longitudinal section 120. In FIG. 4B the positioning of the second rigid longitudinal section 130 and the head 190 relative to the hinge 150 when the oral care implement 100 is in the biased position is illustrated in phantom lines to illustrate the range of flexibility. Of course, the oral care implement 100 can be designed so that the second rigid longitudinal section 130 is capable of more or less pivot/flexibility than that illustrated. The degree of pivot is dependent upon the thickness and density of a resilient material that forms a part of the hinge 150 as well as the thickness of a strut or struts that forms a part of the hinge 150. The strut or struts and resilient material will be described in more detail below with regard to FIGS. 5-9.

The greater the force $F_1$ that is imparted to the head 190, the greater the degree of flex/pivot of the second rigid longitudinal section 130 relative to the first rigid longitudinal section 120. However, in certain embodiments a resilient material 103 (described below) included with the oral care implement 100 has a thickness that is sufficient to prevent over flexure of the second rigid longitudinal section 130 to prevent breakage of the handle 110.

In the exemplified embodiment, the first rigid longitudinal section 120 is a gripping section of the handle 110 and the second rigid longitudinal section 130 is a neck section of the handle 110. Thus, the first rigid longitudinal section 120 of the handle 110 is an elongated structure that provides the mechanism by which the user can hold and manipulate the oral care implement 100 during use. Specifically, during use of the oral care implement 100 the first rigid longitudinal section 120 rests within the palm of the user and the hinge 150 forms a bulbous gripping area for the thumb and forefinger of the user. Furthermore, the second rigid longitudinal section 130 forms the neck section of the handle 110 that is connected to the head 190. It should be appreciated that the handle 110 can take on a wide variety of shapes, contours and configurations, none of which are limiting of the present invention unless specifically claimed. Thus, the handle 110 may comprise additional undulations and regions that are covered in a resilient material to enhance gripability and comfort.

The handle 110 comprises an outer surface 102 that is formed from the rigid material of each of the first and second rigid longitudinal sections 120, 130 and from a resilient material 103 that is located in the region of the hinge 150 of the oral care implement 100. The resilient material 103 provides a comfortable surface for the user to grip during use and enhances the flexibility of the second rigid longitudinal section 130 relative to the first rigid longitudinal section 120 as discussed above. The resilient material 103 forms a portion of the outer surface 102 of the handle 110 around the entire circumference of the handle 110 in the region of the hinge 150.

The handle 110 extends along the longitudinal axis A-A from a proximal end 121 of the first rigid longitudinal section 120 to a distal end 132 of the second rigid longitudinal section 130. Furthermore, the handle 110 has a length $L_H$ measured from the proximal end 121 of the first rigid longitudinal section 120 to the distal end 132 of the second rigid longitudinal section 130. The hinge 150 is located at a distance $D_H$ from the distal end 132 of the second rigid longitudinal section 130. The distance $D_H$ is preferably less than 50% of the length $L_H$ of the handle 110, more preferably between 15% to 40% of the length $L_H$ of the handle 110, and still more preferably between 20% to 35% of the length $L_H$ of the handle 110. As described above, the location of the hinge 150 enables the hinge 150 to be located at or near a region of the handle 110 that a user would grip with his or her thumb and forefinger during use of the oral care implement 100.

Figure 5A:
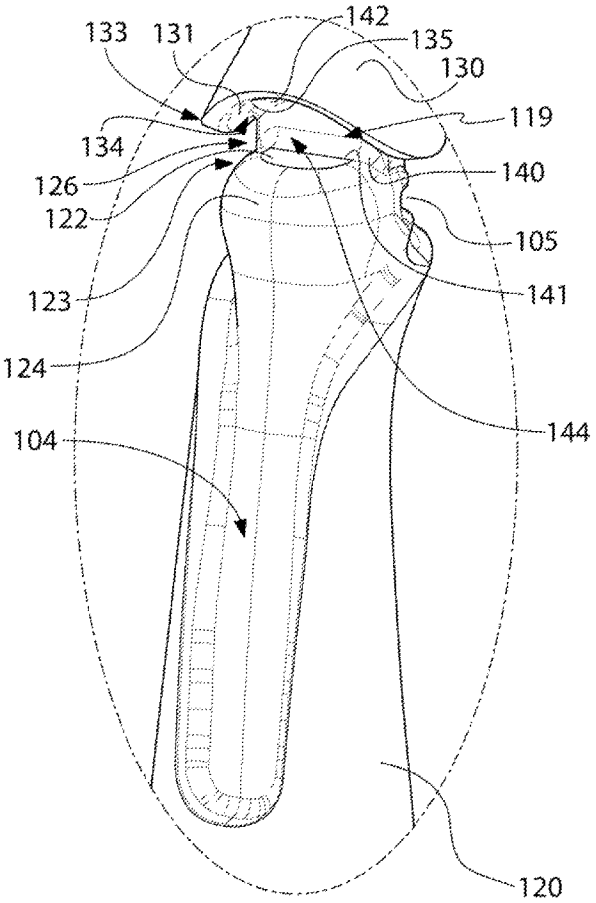
FIG. 5A is a close-up view of area V-A of FIG. 5.
Figure 5:
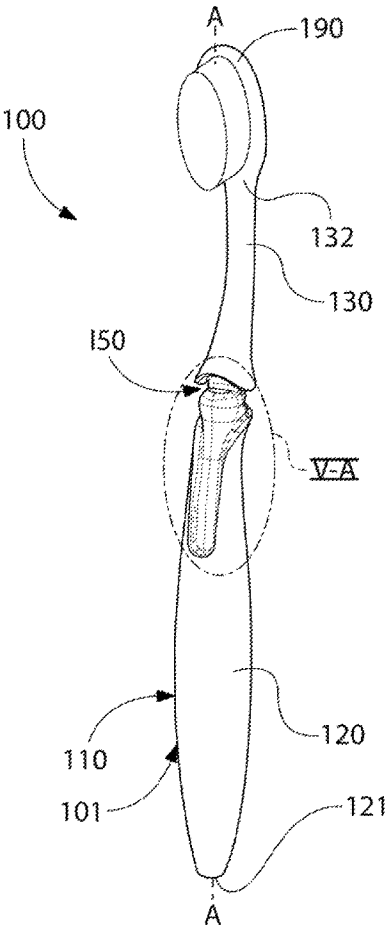
FIG. 5 is a front perspective view of a main body of a handle of the oral care implement of FIG. 1 with the resilient material removed.
Figure 6A:
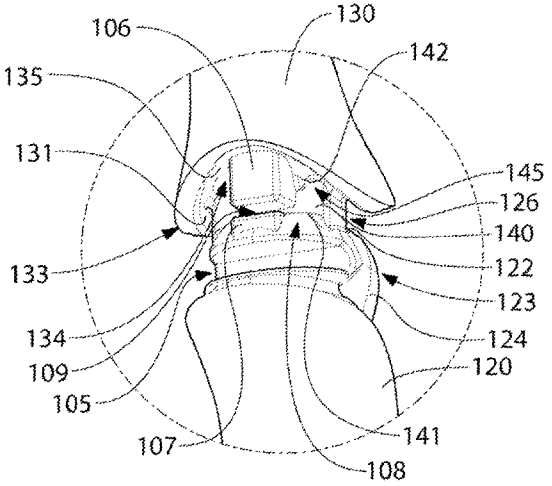
FIG. 6A is a close-up view of area VI-A of FIG. 6.
Figure 6:
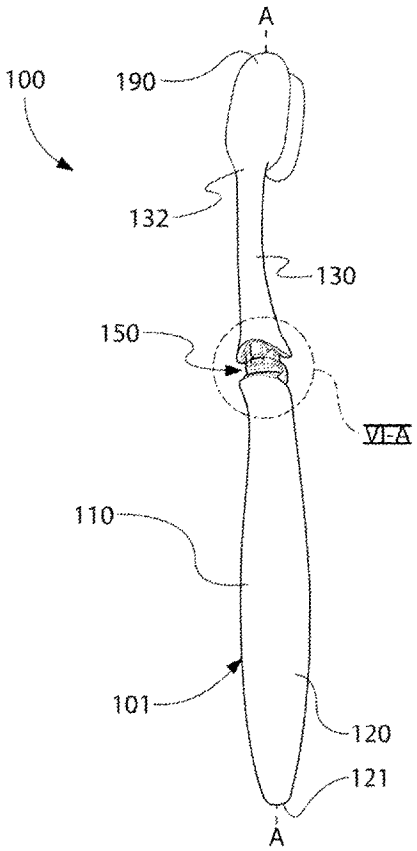
FIG. 6 is a rear perspective view of the main body of the handle of the oral care implement of FIG. 1 with the resilient material removed.
Figure 7A:
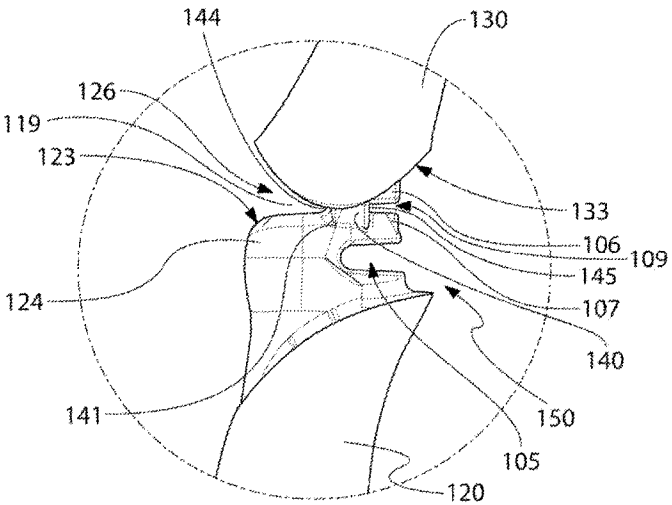
FIG. 7A is a close-up view of area VII-A of FIG. 7.
Figure 7:
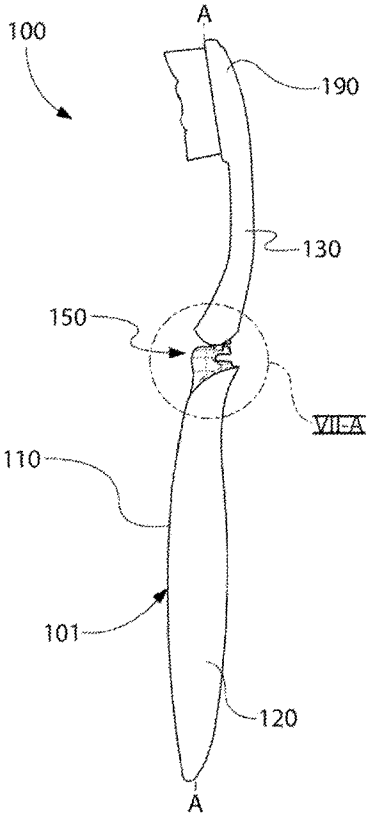
FIG. 7 is a side view of the main body of the handle of the oral care implement of FIG. 1 with the resilient material removed.
Figure 8A:
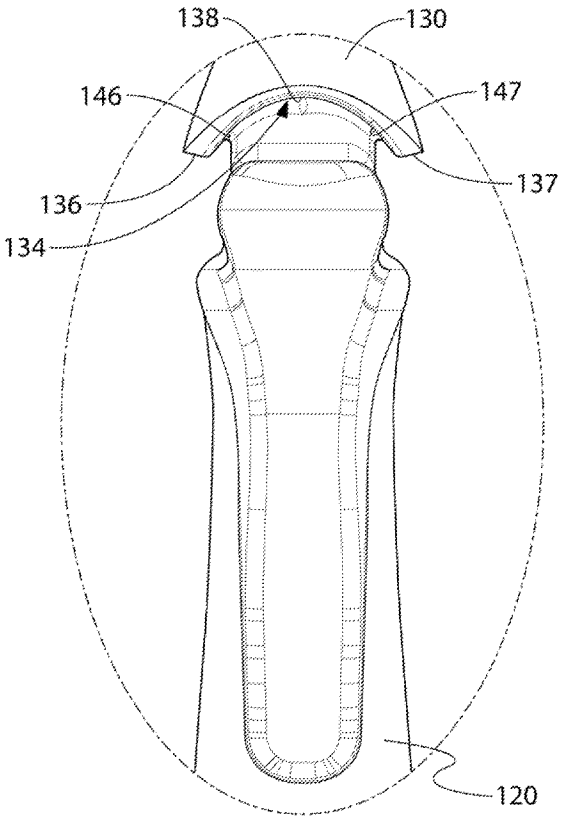
FIG. 8A is a close-up view of area VIII-A of FIG. 8.
Figure 8:
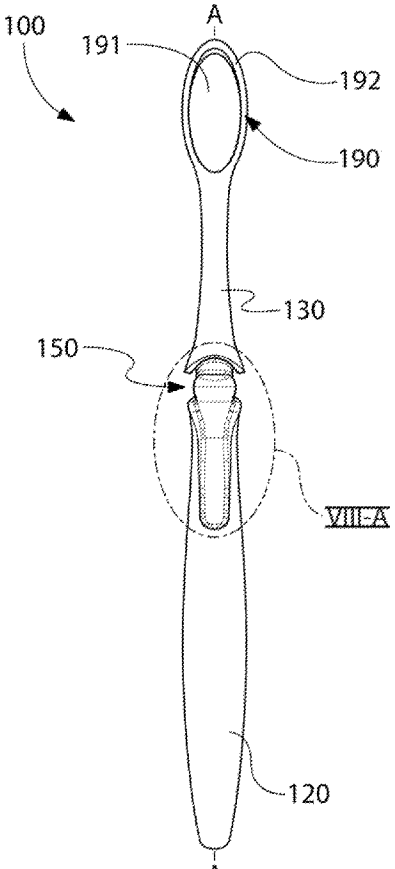
FIG. 8 is a front view of the main body of the handle of the oral care implement of FIG. 1 with the resilient material removed.

Referring to FIGS. 5-7 concurrently, the oral care implement 100 is illustrated with the resilient material 103 removed to depict the components of the hinge 150. In addition to the first and second rigid longitudinal sections 120, 130, the main body 101 of the handle 110 also comprises a longitudinal strut 140. In the exemplified embodiment, the longitudinal strut 140 is a single longitudinal structure that extends substantially coaxially with the longitudinal axis A-A. However, the invention is not to be so limited and in certain other embodiments the longitudinal strut 140 can be formed by a plurality of transversely spaced apart struts, or a single strut centrally positioned within the handle 110 or positioned within the handle 110 near one side of the handle 110.

In the exemplified embodiment, the longitudinal strut 140 is formed of rigid material. Thus, the entire main body 101 of the handle 110 (including the first rigid longitudinal section 120, the second rigid longitudinal section 130 and the longitudinal strut 140) is integrally formed of a rigid material, such as any rigid plastic material. Suitable plastics for the rigid material of the handle 110 include, without limitation, polymers and copolymers of ethylene, propylene, butadiene, vinyl compounds and polyesters such as polyethylene terephthalate.

In certain embodiments, the first rigid longitudinal section 120, the second rigid longitudinal section 130 and the longitudinal strut 140 are integrally formed of the same rigid material. However, the invention is not to be so limited in all embodiments and the longitudinal strut 140 can be formed of a different rigid material than the first and second rigid longitudinal sections 120, 130 in other embodiments. Moreover, as will be described in more detail below, despite the longitudinal strut 140 being formed of the same material as the first and second rigid longitudinal sections 120, 130, the longitudinal strut 140 is more flexible than the first and second rigid longitudinal sections 120, 130 because the longitudinal strut 140 is a portion of the main body 101 of the handle 110 that has a reduced thickness.

It should be appreciated that the term rigid, as used herein with regard to the first and second longitudinal sections 120, 130, is not to be limited to a completely stiff and inflexible structure. Rather, the term rigid is used herein to describe the structure of the first and second longitudinal sections 120, 130 relative to the hinge 150. Thus, in certain embodiments the first and second longitudinal sections 120, 130 may be capable of a certain degree of flexure, but are more firm than the hinge 150 so that during brushing the handle 110 pivots about the hinge 150. Moreover, it should be appreciated that the rigid sections, such as the first and second longitudinal sections 120, 130 of the handle 110, can comprise additional hinge areas or areas of increased flexibility other than or in addition to the hinge 150 in certain embodiments.

The first rigid longitudinal section 120 extends along the longitudinal axis A-A from the proximal end 121 to a distal end 122 and the second rigid longitudinal section 130 extends along the longitudinal axis A-A from a proximal end 131 to the distal end 132. The longitudinal strut 140 extends between and connects the distal end 122 of the first rigid longitudinal section 120 to the proximal end 131 of the second rigid longitudinal section 130. As discussed above, the head 190 is connected to the handle 110, and specifically to the distal end 132 of the second rigid longitudinal section 130 of the handle 110.

The first rigid longitudinal section 120 comprises a first transverse shoulder 123 at its distal end 122. Moreover, the first transverse shoulder 123 comprises a bulbous body 124. In the exemplified embodiment, the first rigid longitudinal section 120 terminates in the bulbous body 124. Furthermore, in exemplified embodiment the bulbous body 124 is a semi-spheroid. However, the invention is not to be so limited in all embodiments and the bulbous body 124 can take on other shapes. The second rigid longitudinal section 130 comprises a second transverse shoulder 133 at its proximal end 131. Moreover, the second transverse shoulder 133 comprises a basin 134 having a floor 135. In the exemplified embodiment, the second rigid longitudinal section 130 terminates in the basin 134. The distal end 122 of the first rigid longitudinal section 120 is adjacent the proximal end 131 of the second rigid longitudinal section 130. However, as described below, the first and second transverse shoulders 123, 133, and hence also the bulbous body 124 and the basin 134, are spaced from one another.

Although the invention is illustrated and described herein such that the first rigid longitudinal section 120 (i.e., the gripping section) terminates in the bulbous body 124 and the second rigid longitudinal section 130 (i.e., the neck section) terminates in the basin 134, the invention is not to be so limited. Thus, in certain embodiments the first rigid longitudinal section 120 may comprise and terminate in a basin while the second rigid longitudinal section 130 may comprise and terminate in a bulbous body. Thus, according to the present invention, one of the first rigid longitudinal section 120 (i.e., the gripping section) or the second rigid longitudinal section 130 (i.e., the neck section) comprises a bulbous body and the other one of the first rigid longitudinal section 120 or the second rigid longitudinal section 130 comprises a basin.

Figure 12A:
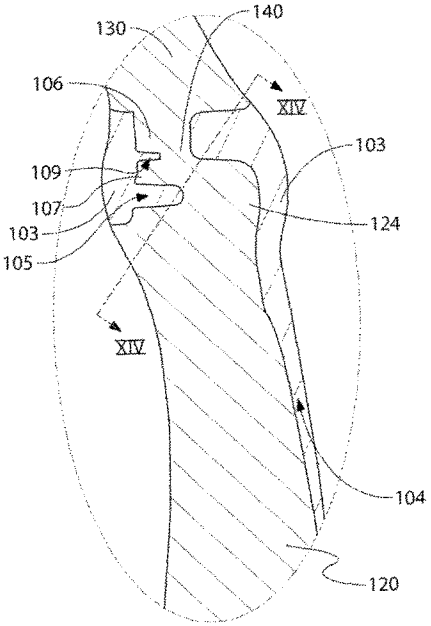
FIG. 12A is a close-up of area XII-A of FIG. 12.
Figure 12:
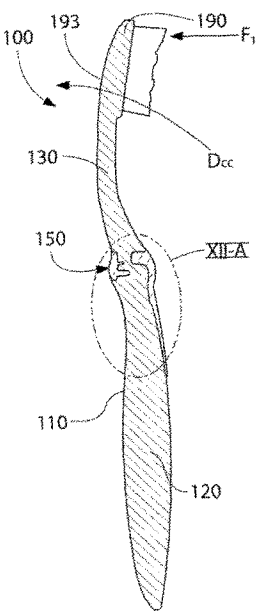
FIG. 12 is a longitudinal cross-sectional view taken along line XII-XII of FIG. 2.

The longitudinal strut 140 extends axially from a first end 141 to a second end 142 and transversely from a front surface 144 to a rear surface 145. Thus, the first end 141 of the longitudinal strut 140 is connected to the bulbous body 124, and more specifically to the first transverse shoulder 123, and the second end 142 of the longitudinal strut 140 is connected to the floor 135 of the basin 134, and more specifically to the second transverse shoulder 133. In certain embodiments, the longitudinal strut 140 extends axially from an apex of the bulbous body 124. Moreover, in certain embodiments the apex of the bulbous body 124 is a convex surface. Due to its axial connection between the floor 135 of the basin 134 and the bulbous body 124, the longitudinal strut 140 provides separation between the bulbous body 124 and the basin 134 such that the bulbous body 124 and the floor 135 of the basin 134 are separated by a separation gap 126. The separation gap 126 is an annular channel that circumferentially surrounds the longitudinal strut 140. The separation gap 126 is filled with the resilient material 103 in a manner such that resilient material 103 encases the longitudinal strut 140 (FIGS. 12 and 12A).

The separation gap 126 generally comprises a flexure limiting gap 109 and a flexure facilitating gap 119. The flexure limiting gap 109 is located adjacent the rear surface 145 of the longitudinal strut 140 and the flexure facilitating gap 119 is located adjacent a front surface 144 of the longitudinal strut. More specifically, the flexure facilitating gap 119 separates the first and second transverse shoulders 123, 133 from one another. Each of the flexure limiting gap 109 and the flexure facilitating gap 119 are filled with the resilient material 103. The flexure limiting gap 109 and the flexure facilitating gap 119 work together to facilitate pivoting of the second rigid longitudinal section 130 relative to the first rigid longitudinal section 120 while preventing over flexure, permanent deformation and/or breakage of the oral care implement 100.

The hinge 150 generally comprises the longitudinal strut 140 and the resilient material 103 which encases the longitudinal strut 140. More specifically, the hinge 150 comprises the bulbous body 124, the basin 134, the longitudinal strut 140 and the resilient material 103 that is in the separation gap 126. Thus, the hinge 150, and more specifically the longitudinal strut 140 and the resilient material 103 encasing the longitudinal strut 140, enables the second rigid longitudinal section 130 to pivot relative to the first rigid longitudinal section 120 upon the force $F_1$ being applied to the head 190 as described above with reference to FIGS. 4A and 4B. It should be appreciated that because the hinge 150 comprises the longitudinal strut 140, the longitudinal strut 140 is located at the distance $D_H$ from the distal end 132 of the second rigid longitudinal section 130.

In the exemplified embodiment, the outer surface 102 of the handle 110 of the oral care implement 100 comprises an axial groove 104 that extends axially from the hinge 150 toward the proximal end 121 of the first rigid longitudinal section 120 (i.e., the gripping section). The axial groove 104 is filled in with the resilient material 103 (FIGS. 12 and 12A). Thus, the resilient material 103 that fills in the axial groove 104 forms a gripping surface for the user, and specifically for the user's thumb. Forming portions of the outer surface 102 of the handle 110 out of the resilient material 103 prevents mishandling of the oral care implement 100 during use under wet conditions because the resilient material 103 enhances gripability of the handle 110.

Figure 13A:
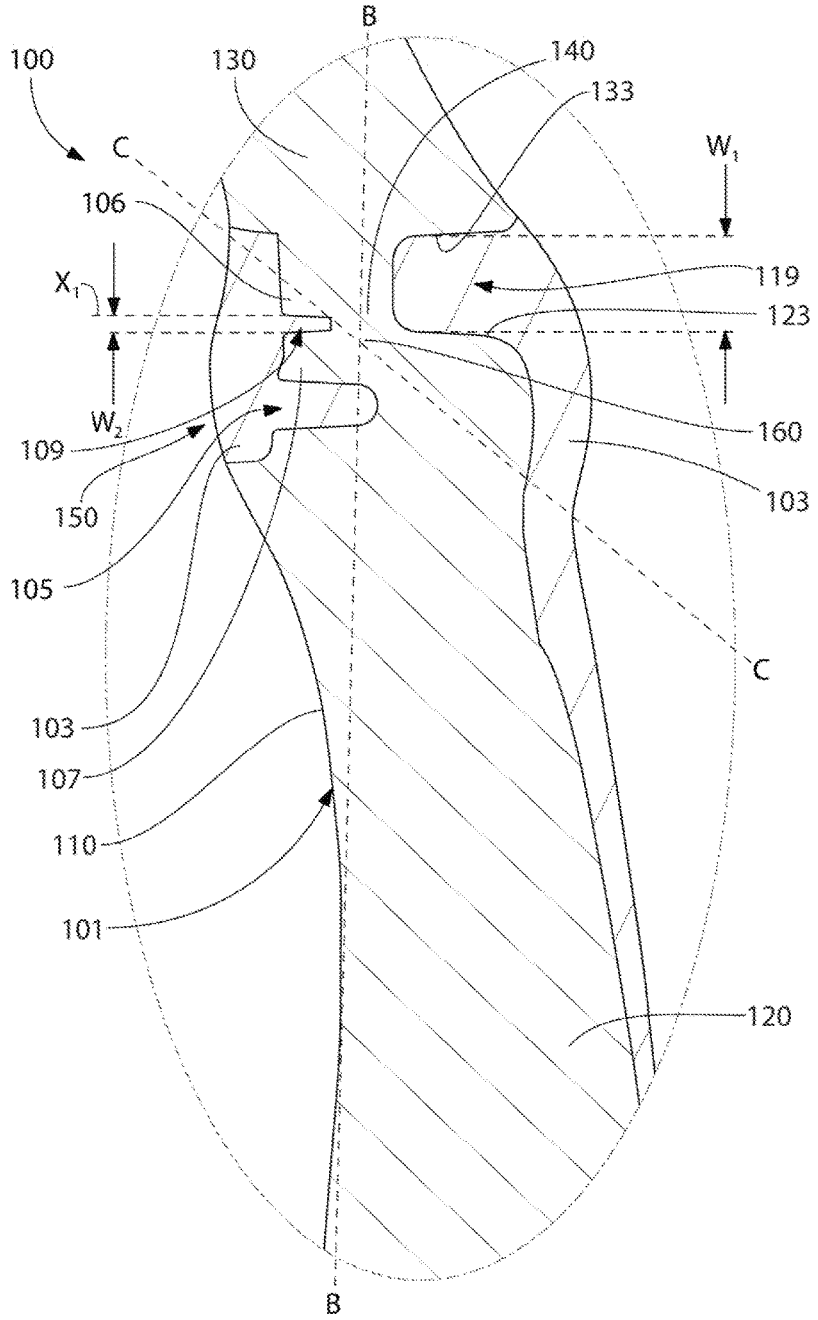
FIG. 13A is a close-up of area XII-A of FIG. 12, wherein the oral care implement is in a biased state.
Figure 13B:
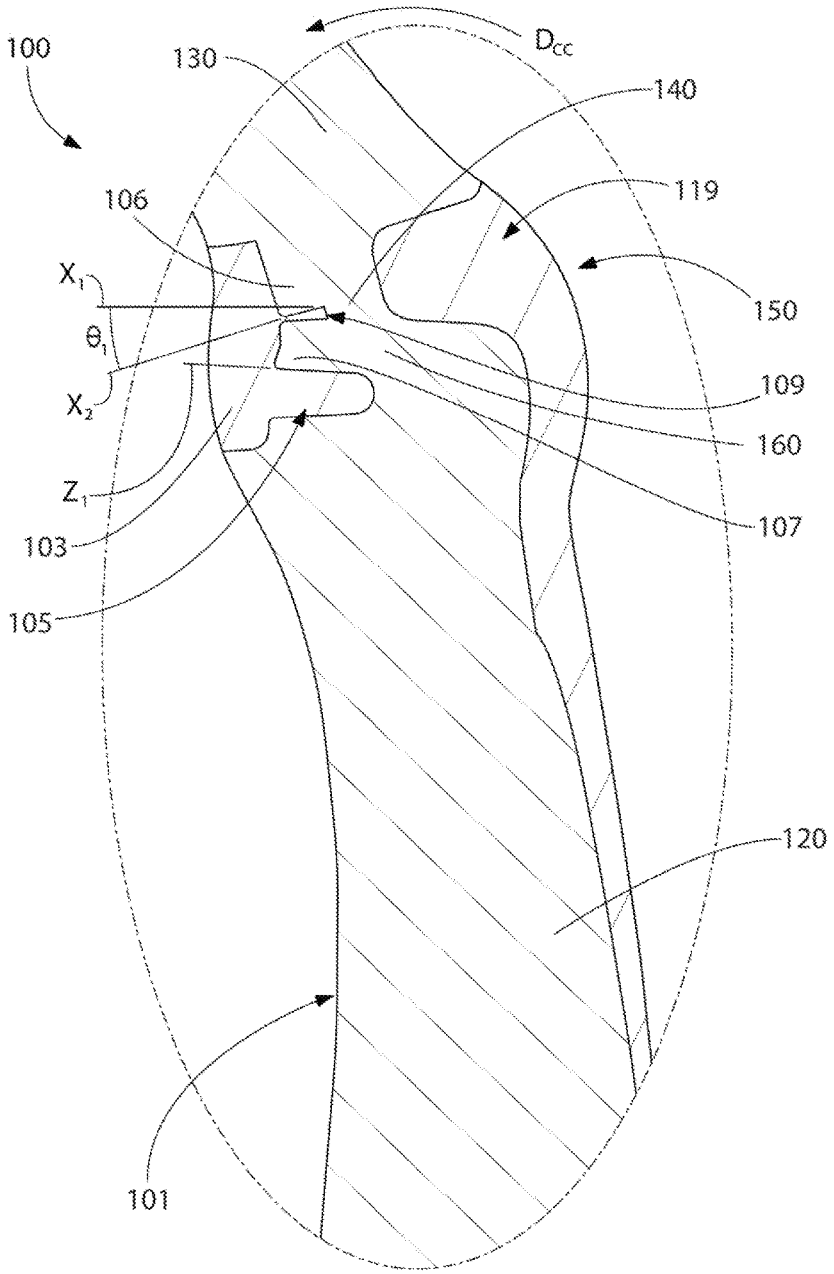
FIG. 13B is the close-up illustrated in FIG. 13A, wherein the second rigid longitudinal section is pivoted relative to the first rigid longitudinal section about the first strut.
Figure 13C:
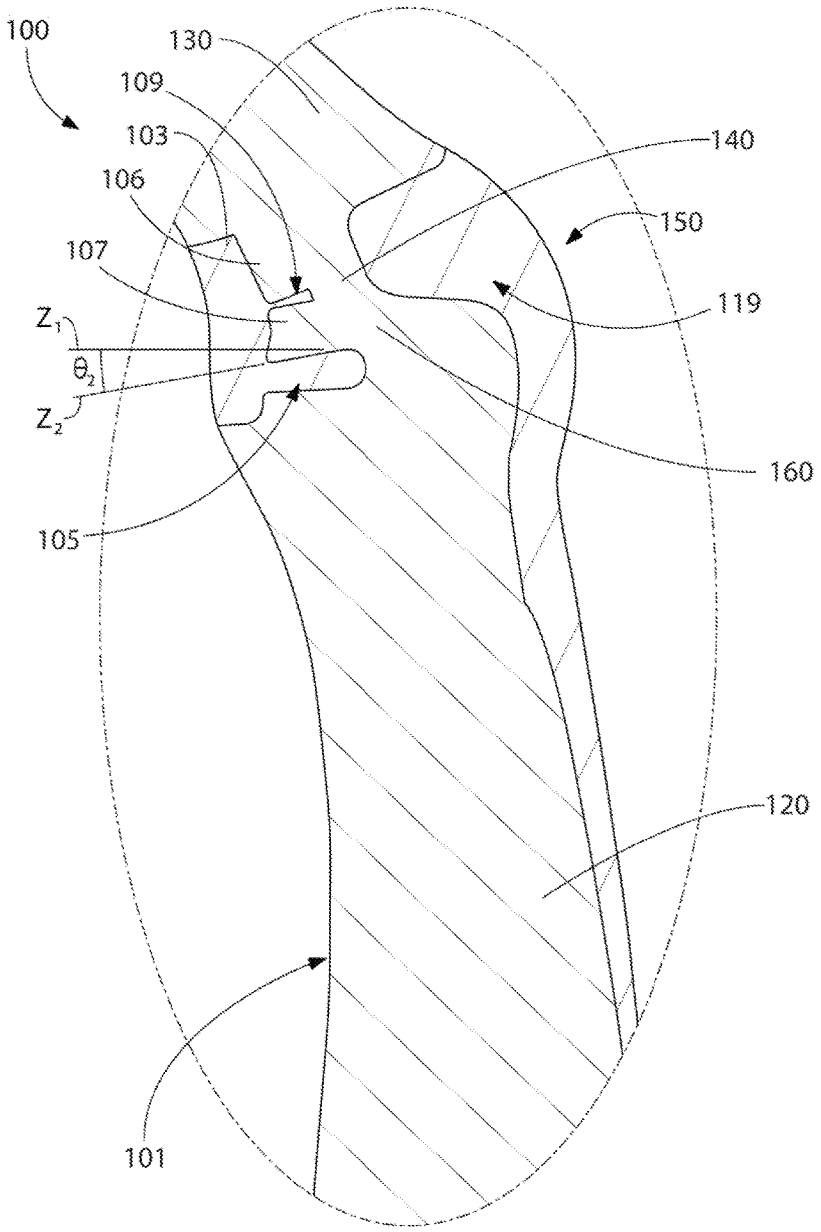
FIG. 13C is the close-up illustrated in FIG. 13B, wherein the second rigid longitudinal section is also pivoted relative to the first rigid longitudinal section about a second strut.

In the exemplified embodiment, the bulbous body 124 comprises a transverse channel 105 extending therethrough. As will be discussed below with reference to FIGS. 13A-13C, the transverse channel 105 acts as a secondary flexure limiting gap that provides additional flex/pivot about the hinge 150. The transverse channel 105 is formed into a rear surface 108 of the bulbous body 124 and forms a transverse passageway through the bulbous body 124. However, the transverse channel 105 can be omitted in other embodiments (FIGS. 13, 14A and 14B, discussed below).

In the exemplified embodiment, the oral care implement 100 comprises a first flexure limiting block 107 protruding from the rear surface 108 of the bulbous body 124 and a second flexure limiting block 106 protruding from the floor 135 of the basin 134. Each of the first and second flexure limiting blocks 107, 106 are comprised by and formed integrally with the main body 101 of the oral care implement 100. More specifically, the first flexure limiting block 107 extends axially from the bulbous body 124 into the separation gap 126 and the second flexure limiting block 106 extends axially from the floor 135 of the basin 134 into the separation gap 126. In certain embodiments, the first transverse shoulder 123 comprises a convex surface, and the first flexure limiting block 107 is connected to and protruding from the convex surface of the first transverse shoulder 123. The second flexure limiting block 106 is connected to the second transverse shoulder 133 and to the rear surface 145 of the strut 140.

The first and second flexure limiting blocks 107, 106 are circumferentially aligned with one another and with the rear surface 193 of the head 190. Furthermore, despite each of the first and second flexure limiting blocks 107, 106 extending into the separation gap 126, the first and second flexure limiting blocks 107, 106 are axially spaced apart from one another. Thus, the flexure limiting gap 109 is formed between the first and second flexure limiting blocks 107, 106. As illustrated in FIG. 12A, the resilient material 103 is disposed within and fills in the flexure limiting gap 109. Furthermore, the resilient material 103 encases each of the longitudinal strut 140, the first flexure limiting block 107 and the second flexure limiting block 106.

In the exemplified embodiment, each of the first and second flexure limiting blocks 107, 106 comprise a substantially rectangular shape. Of course, the invention is not to be so limited in all embodiments and in certain other embodiments the first and second flexure limiting blocks 107, 106 can take on other shapes. Furthermore, in certain embodiments the first and second flexure limiting blocks 107, 106 have the same shape and in certain other embodiments the first and second flexure limiting blocks 107, 106 can have different shapes.

Due to the first and second flexure limiting blocks 107, 106, the flexure limiting gap 109 and the resilient material 103 therein, the second rigid longitudinal section 130 is able to pivot relative to the first rigid longitudinal section 120 about the hinge 150. Specifically, when the force $F_1$ is applied to the head 190 of the oral care implement 100, the resilient material 103 in the flexure limiting gap 109 becomes compressed and the first and second flexure limiting blocks 107, 106 come into contact with one another. Thus, the first and second flexure limiting blocks 107, 106 prevent overflexing the handle 110 to the breaking point of the handle 110. However, one or both of the flexure limiting blocks 106, 107 may be omitted in certain other embodiments as will be discussed below with reference to FIG. 13.

Referring to FIGS. 8-10B concurrently, the oral care implement 100 will be further described. In the exemplified embodiment as has been described herein above, the basin 134 forms the proximal end 131 of the second rigid longitudinal section 130 (i.e., the rigid neck section). Furthermore, the second rigid longitudinal section 130 comprises a first flange 136 and a second flange 137. The first and second flanges 136, 137 extend axially from the floor 135 of the basin 134 to form opposing sidewalls of the basin 134. Furthermore, the first and second flanges 136, 137 also flare radially outward from the longitudinal axis A-A. Thus, the first flange 136 forms a first sidewall 146 of the basin 134 and the second flange 137 forms a second sidewall 147 of the basin 134. The first flange 136 is circumferentially spaced apart from the second flange 137 by a first valley 138 that is circumferentially aligned with the rear surface 193 of the head 190 and a second valley 139 that is circumferentially aligned with the front surface 192 of the head 190. Thus, as a result of the flanges 136, 137 and valleys 138, 139, the second rigid longitudinal section 130 terminates in an undulating annular edge.

Figure 10A:
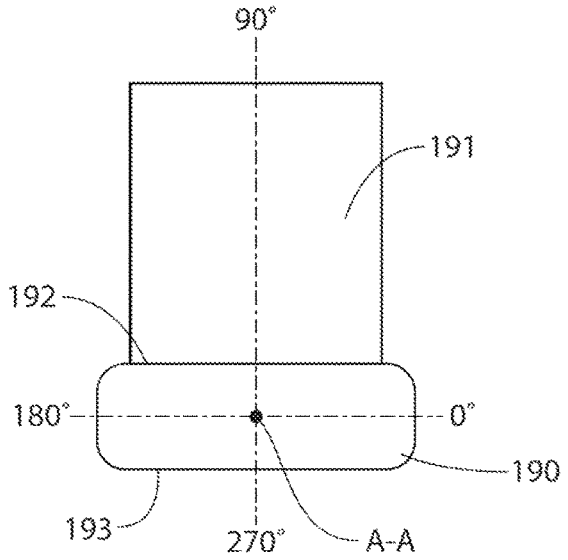
FIG. 10A is a top view of the oral care implement of FIG. 1.
Figure 10B:
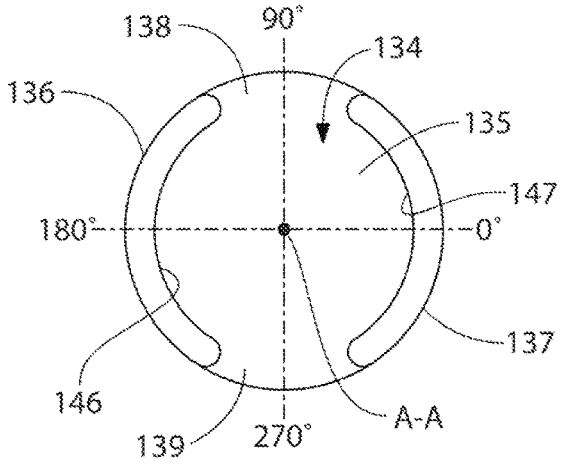
FIG. 10B is a bottom view of a second rigid longitudinal section of the oral care implement of FIG. 1.

FIGS. 10A and 10B are illustrated with the plane angle measurements 0°, 90° 180° and 270° to exemplify the positioning of the flanges 136, 137 and valleys 146, 147 relative to the front and rear surfaces 192, 193 of the head 190. Thus, FIGS. 10A and 10B illustrate that the first and second valleys 146, 147 are circumferentially aligned with the front and rear surfaces 192, 193 of the head 190, respectively, as discussed above.

Figure 9A:
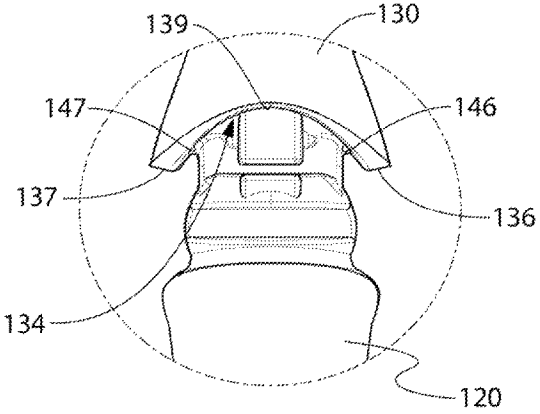
FIG. 9A is a close-up view of area IX-A of FIG. 9.
Figure 9:
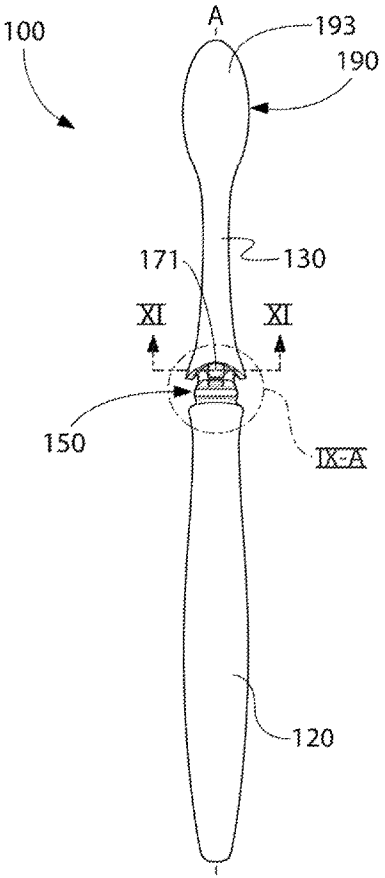
FIG. 9 is a rear view of the main body of the handle of the oral care implement of FIG. 1 with the resilient material removed.
Figure 11:
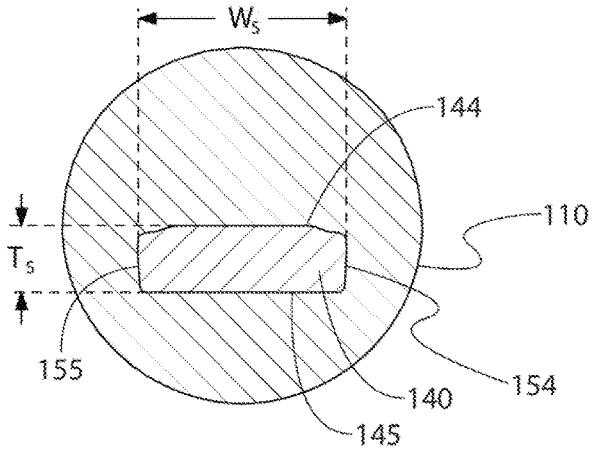
FIG. 11 is a schematic cross-sectional view taken along line XI-XI of FIG. 9.

Referring to FIGS. 9 and 11, a schematic representation of a transverse cross-section taken through the longitudinal strut 140 at an axial location 171 is illustrated. In the exemplified embodiment, the longitudinal strut 140 has a thickness $T_S$ measured from the front surface 144 of the longitudinal strut 140 to the rear surface 145 of the longitudinal strut 140. Furthermore, the longitudinal strut 140 has a width $W_S$ measured from a first side surface 154 of the longitudinal strut 140 to a second side surface 155 of the longitudinal strut 140. The width $W_S$ of the longitudinal strut 140 is greater than the thickness $T_S$ of the longitudinal strut 140.

In the exemplified embodiment, the longitudinal strut 140 comprises a substantially rectangular transverse cross-sectional area. Of course, the invention is not to be so limited in all embodiments and in certain other embodiments the longitudinal strut 140 can have other cross-sectional shapes. Furthermore, as noted above, in still other embodiments the longitudinal strut 140 may be formed by a plurality of struts that are transversely spaced from one another.

The handle 110 comprises a first transverse cross-sectional area taken at the axial location 171 of the longitudinal strut 140 and the longitudinal strut 140 has a second transverse cross-sectional area taken at the axial location 171. The second transverse cross-sectional area of the longitudinal strut 140 at the axial location 171 is in a range between 7% to 35% of the first transverse cross-sectional area of the handle 110 at the axial location 171.

Referring to 12 and 12A, as discussed above, the separation gap 126 between the bulbous body 124 and the floor 135 of the basin 134 is filled with the resilient material 103. In certain embodiments, the separation gap 126 is filled with the resilient material 103 in a manner such that resilient material 103 encases the longitudinal strut 140. Furthermore, the resilient material 103 also encases the floor 135 of the basin 134 and the bulbous body 124 such that in the fully assembled oral care implement 100 illustrated in FIGS. 1-3, neither the basin 134 nor the bulbous body 124 is exposed because it is entirely covered by the resilient material 103 (see FIGS. 1-3). In certain embodiments, the resilient material 103 is an injection molded thermoplastic elastomer. However, the invention is not to be so limited in all embodiments and other materials that can provide resiliency and flexibility to the handle 110 as has been described herein can be used.

In the exemplified embodiment illustrated in FIGS. 12 and 12A, the rear surface 193 of the head 190 is facing a counter-clockwise direction $D_{CC}$ such that the force $F_1$ acting on the head 190 of the oral care implement 100 will result in the second rigid longitudinal section 130 pivoting relative to the first rigid longitudinal section 120 in the counter-clockwise direction $D_{CC}$. As will be discussed below with reference to FIGS. 13A-13C, the first and second flexure limiting blocks 107, 106 limit the pivoting of the second rigid longitudinal section 130 relative to the first rigid longitudinal section 120 in the counter-clockwise direction $D_{CC}$.

Referring to FIGS. 13A-13C, the pivoting of the second rigid longitudinal section 130 relative to the first rigid longitudinal section 120 will be further described. As discussed in detail above, the oral care implement 100 of the present invention includes a longitudinal strut 140 that extends between and connects the first rigid longitudinal section 120 to the second rigid longitudinal section 130. Furthermore, in addition to the longitudinal strut 140, the main body 101 further comprises an oblique strut 160 that is formed into the first transverse shoulder 123 and forms a part of the hinge 150. The transverse channel 105 forms the oblique strut 160 into the first transverse shoulder 123. In certain embodiments, the longitudinal strut 140 can be considered a first strut whereas the oblique strut 160 can be considered a second strut.

In the exemplified embodiment, the longitudinal strut 140 extends along a first axis B-B and the oblique strut 160 extends along a second axis C-C. The first axis B-B and the second axis C-C intersect at an oblique angle. In the exemplified embodiment, the longitudinal strut 140 extends in a substantially axial direction relative to the longitudinal axis A-A of the handle 110 and the oblique strut 160 extends in a substantially oblique direction relative to the longitudinal strut 140. However, the invention is not to be so limited in all embodiments and in certain other embodiments the oblique strut 160 can be oriented in a similar, longitudinal direction relative to the longitudinal strut 140.

The flexure facilitating gap 119 is the space between the first transverse shoulder 123 of the first rigid longitudinal section 120 of the main body 101 of the handle 110 and the second transverse shoulder 133 of the second rigid longitudinal section 130 of the main body 101 of the handle 110. The flexure facilitating gap 119 has a first width $W_1$ extending between the first transverse shoulder 123 of the first rigid longitudinal section 120 and the second transverse shoulder 133 of the second rigid longitudinal section 130. Furthermore, the flexure limiting gap 109 is the space between the first flexure limiting block 107 and the second flexure limiting block 106. The flexure limiting gap 109 has a second width $W_2$ extending between the first flexure limiting block 107 and the second flexure limiting block 106. The second width $W_2$ is less than the first width $W_1$. In certain embodiments, a ratio of the second width $W_2$ to the first width $W_1$ is in a range of 0.1 to 0.6.

In FIG. 13A, the oral care implement 100 is illustrated in the biased state as has been described above wherein there is no force acting on the second rigid longitudinal section 130 of the main body 101 relative to the first rigid longitudinal section 120 of the main body 101. In this biased state, a first reference line $X_1$ is aligned with a bottom surface of the second flexure limiting block 106. The first reference line $X_1$ will be described in more detail below to discuss the degree of pivot that occurs when a force is applied to the head 190 of the oral care implement.

Referring now to FIGS. 13A and 13B concurrently, the oral care implement 100 will be described with regard to the pivot of the second rigid longitudinal section 130 relative to the first rigid longitudinal section 120 when an initial force $F_1$ is applied to the head. In FIG. 13B, the oral care implement 100 is illustrated with the force $F_1$ being applied to the head (the head is not illustrated in this figure in order to provide a close-up of the pivoting movement taking place at the hinge 150). During initial application of the force $F_1$, the second rigid longitudinal section 130 of the main body 101 initially pivots relative to the first rigid longitudinal section 120 of the main body 101 about the longitudinal strut 140 a first angle $\theta_1$. The degree of the first angle $\theta_1$ can be determined by comparing the first reference line $X_1$ with a second reference line $X_2$ that is aligned with the bottom surface of the second flexure limiting block 106 after the initial pivot. In certain embodiments, the first angle $\theta_1$ is less than or equal to about 25°, and in certain other embodiments the first angle $\theta_1$ is between 10°-20°. The first angle $\theta_1$ is such as to prevent permanent deformation or breakage of the longitudinal strut 140. During initial application of the force $F_1$, there is no pivoting that occurs about the oblique strut 160 and thus a third reference line $Z_1$ is aligned with the bottom surface of the first flexure limiting block 107.

During initial application of the force $F_1$, the resilient material 103 in the flexure limiting gap 109 compresses and the second flexure limiting block 106 pivots about the longitudinal strut 140 into the flexure limiting gap 109 towards the first flexure limiting block 107. The first and second flexure limiting blocks 107, 106 prevent over flexure of the oral care implement 100. More specifically, mechanical interference between the first and second flexure limiting blocks 107, 106 limits pivoting of the second rigid longitudinal section 130 relative to the first rigid longitudinal section 120 in the counter-clockwise direction $D_{CC}$ when the rear surface 193 of the head 190 is facing the counter-clockwise direction $D_{CC}$ as discussed above with reference to FIG. 12. In the exemplified embodiment, the first and second flexure limiting blocks 107, 106 remain spaced from one another by the resilient material 103 in the flexure limiting gap 109 even after the pivoting motion illustrated in FIG. 13B. Of course, the invention is not to be so limited and in certain other embodiments the mechanical interference may be achieved via actual contact between the first and second flexure limiting blocks 107, 106.

Referring to FIGS. 13B and 13C concurrently, the oral care implement 100 will be described after a subsequent pivoting motion of the second rigid longitudinal section 130 relative to the first rigid longitudinal section 120. The mechanical interference between the first and second flexure limiting blocks 107, 106 discussed above causes pivoting of the second rigid longitudinal section 130 relative to the first rigid longitudinal section 120 to transition from the longitudinal strut 140 to the oblique strut 160. Thus, upon further application of the force $F_1$ after the mechanical interference occurs, the second rigid longitudinal section 160 begins to pivot about the oblique strut 160 rather than about the longitudinal strut 140. Thus, the subsequent pivot causes the resilient material 103 positioned within the transverse channel 105 to compress such that the bottom surface of the first flexure limiting block 107 pivots downwardly into the transverse channel 105 and the second rigid longitudinal section 130 pivots relative to the first rigid longitudinal section 120 about the oblique strut 160 a second angle $\theta_2$.

The degree of the second angle $\theta_2$ can be determined by comparing the third reference line $Z_1$ with a fourth reference line $Z_2$ that is aligned with the bottom surface of the first flexure limiting block 107 after the subsequent pivot. In certain embodiments, the second angle $\theta_2$ is less than the first angle $\theta_1$ and in certain other embodiments the second angle $\theta_2$ is greater than the first angle $\theta_1$. The second angle $\theta_2$ assists in preventing permanent deformation or breakage of the oblique strut 160. During pivoting about the oblique strut 160, the first angle $\theta_1$ remains as discussed above, such as less than 25°.

The longitudinal strut 140 and the oblique strut 160 connect the first rigid longitudinal section 120 and the second rigid longitudinal section 130 such that a first torque is required to pivot the second rigid longitudinal section 130 relative to the first rigid longitudinal section 120 about the longitudinal strut 140 the first angle $\theta_1$ and a second torque is required to subsequently pivot the second longitudinal section 130 relative to the first rigid longitudinal section 120 about the oblique strut 160 a second angle $\theta_2$, the second torque being greater than the first torque. Thus, a greater amount of force or torque is used during pivoting about the oblique strut 160 than is used during pivoting about the longitudinal strut 140.

Figure 14:
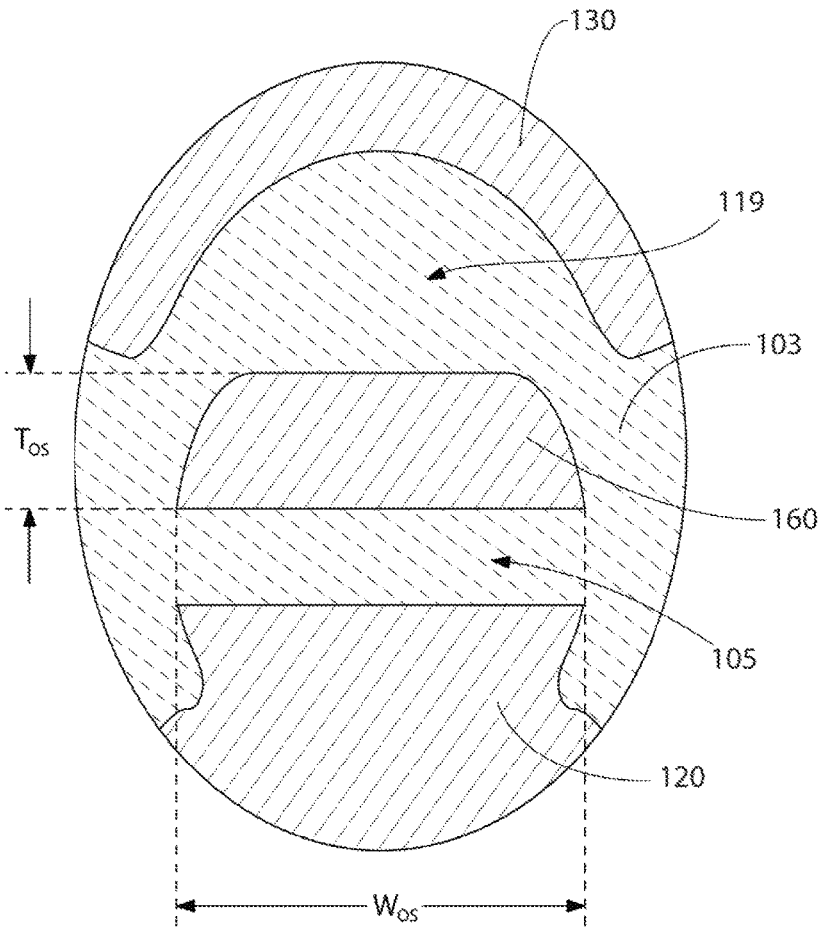
FIG. 14 is a cross-sectional view taken along line XIV-XIV of FIG. 12A.

Referring to FIGS. 11 and 14 concurrently, the relative transverse cross-sectional areas of the longitudinal strut 140 and the oblique strut 160 will be described. FIG. 11 illustrates a cross-section taken at a point along the first axis B-B and FIG. 14 illustrates a cross-section taken at a point along the second axis C-C. As discussed above, the longitudinal strut 140 has a width Ws and a thickness $T_S$. The longitudinal strut 140 also has a first transverse cross-sectional area that is equal to the width $W_S$ times the thickness $T_S$. The oblique strut 160 has a width $W_{OS}$ and a thickness $T_{OS}$. The oblique strut 160 also comprises a second transverse cross-sectional area that is equal to the width $W_{OS}$ times the thickness $T_{OS}$. The second transverse cross-sectional area of the oblique strut 160 is greater than the first transverse cross-sectional area of the longitudinal strut 140. This difference in the cross-sectional areas of the longitudinal strut 140 and the oblique strut 160 facilitates that a larger torque is required to pivot the second rigid longitudinal section 130 relative to the first rigid longitudinal section 120 about the oblique strut 160 than is required to pivot the second rigid longitudinal section 130 relative to the first rigid longitudinal section 120 about the longitudinal strut 140.

Figure 15A:
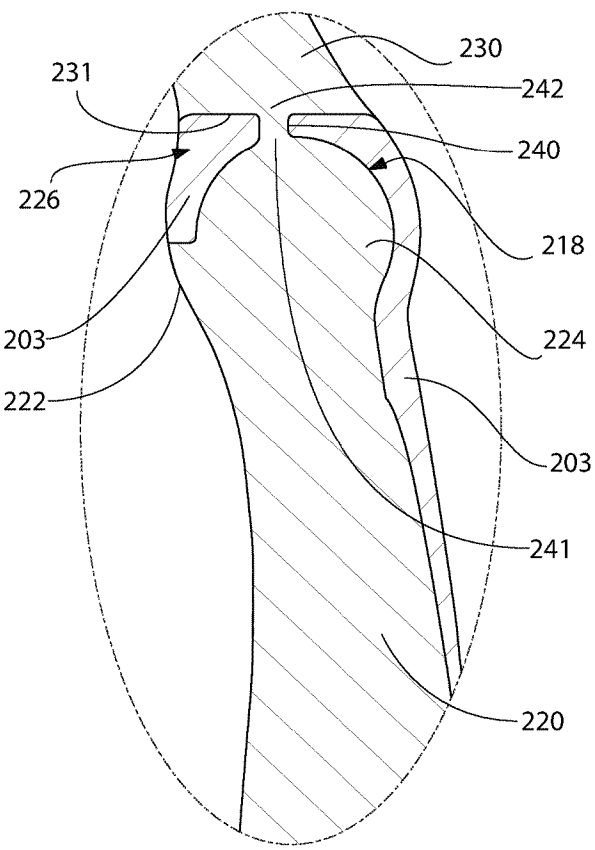
FIG. 15A is a close-up of area XVA of FIG. 13.
Figure 15:
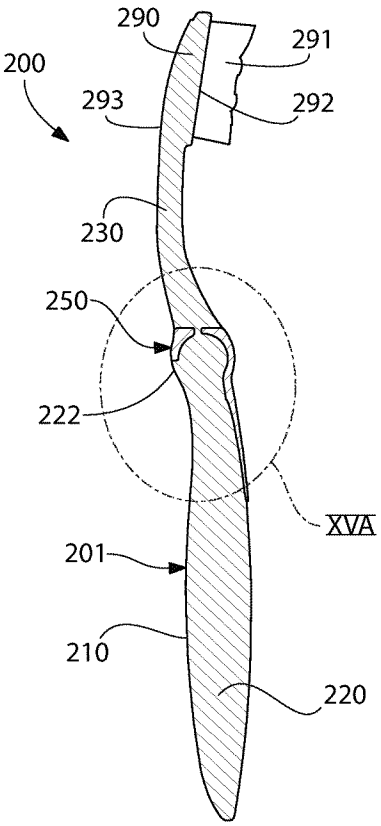
FIG. 15 is a longitudinal cross-sectional view of an oral care implement in accordance with a second embodiment of the present invention.

Referring to FIGS. 15 and 15A, an oral care implement 200 in accordance with a second embodiment of the present invention will be described. The oral care implement 200 is similar to the oral care implement 100 in many aspects, and therefore similar features will be similarly numbered except that the 200-series of numbers will be used. Furthermore, the specific structure of features of the oral care implement 200 that are similar to or the same as features of the oral care implement 100 will not be repeated in the interest of brevity.

The oral care implement 200 comprises a handle 210 that is connected to a head 290. The head 290 comprises a front surface 292 and an opposing rear surface 293 with tooth cleaning elements 291 extending outwardly from the front surface 292. Specifically, the handle 210 comprises a main body 201 comprising a first rigid longitudinal section 220, a second rigid longitudinal section 230 and a hinge 250. The first rigid longitudinal section 220 is spaced from the second rigid longitudinal section 230 by a gap 226. A flexible strut 240 extends longitudinally from the first rigid longitudinal section 220 and connects to the second longitudinal section 230. Thus, the first rigid longitudinal section 220, the second rigid longitudinal section 230 and the flexible strut 240 are integrally formed of a rigid plastic material, such as, without limitation, polymers and copolymers of ethylene, propylene, butadiene, vinyl compounds and polyesters such as polyethylene terephthalate.

The first rigid longitudinal section 220 terminates at its proximal end 222 in a bulbous body 224 having a convex outer surface 218. Thus, in this embodiment the flexible strut 240 extends axially from the convex outer surface 218 of the bulbous body 224 of the first rigid longitudinal section. The flexible strut 240 comprises a first end 241 that is connected to the convex outer surface 218 of the bulbous body 224 at the proximal end 222 of the first rigid longitudinal section 220 and a second end 242 that is connected to a distal end 231 of the second rigid longitudinal section 230.

The gap 226 is filled with a resilient material 203, such as a thermoplastic elastomer. Of course, the resilient material 203 is not limited to being a thermoplastic elastomer and other resilient materials may be used as desired. The resilient material 203 encases and circumferentially surrounds the flexible strut 240. The resilient material 203 also encases the bulbous body 224 and the distal end 231 of the second rigid longitudinal section 230, which in certain embodiments comprises a basin (such as described above with regard to the oral care implement 100).

The combination of the flexible strut 240 and the resilient material 203 combine to form the hinge 250 of the oral care implement 200. The hinge 250 forms a region of the handle 110 upon which the second rigid longitudinal section 230 pivots relative to the first rigid longitudinal section 220 upon a brushing force, such as the force $F_1$ described above with regard to the oral care implement 100, being applied to the head 290. The main difference between the oral care implement 200 and the oral care implement 100 is that the oral care implement 200 omits the flexure limiting blocks 106, 107 and the transverse channel 105. Furthermore, the surface of the bulbous body 224 of the oral care implement 200 from which the flexible strut 240 extends is convex whereas the surface of the bulbous body 124 of the oral care implement 100 from which the longitudinal strut 140 extends is relatively flat. Nonetheless, operation and flexibility of the oral care implement 200 is similar to that of the oral care implement 100 described above.

Figure 16A:
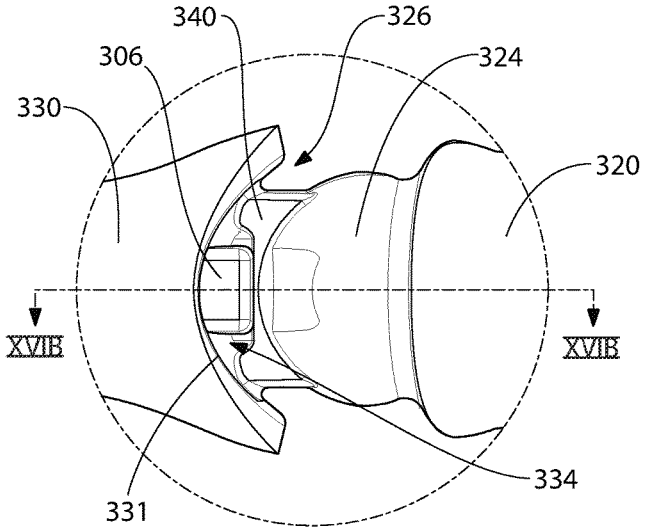
FIG. 16A is a close-up of the hinge section of an oral care implement in accordance with a third embodiment of the present invention.
Figure 16B:
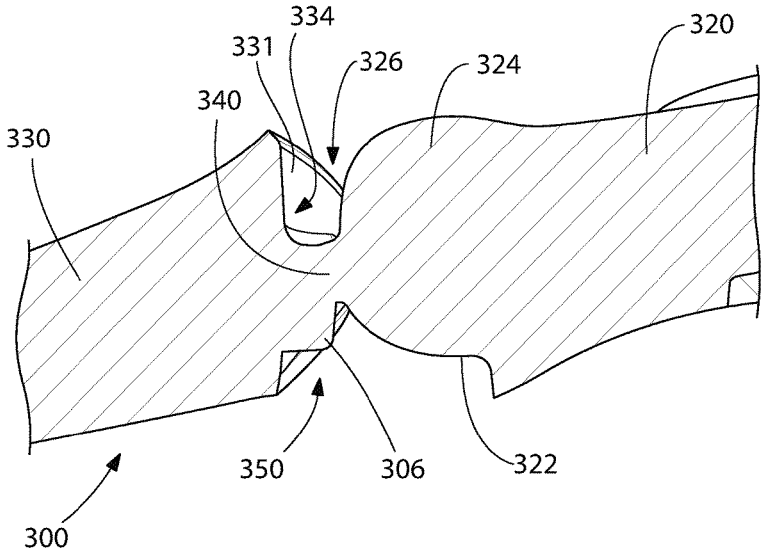
FIG. 16B is a cross-sectional view taken along line XVIB-XVIB of FIG. 16A.

Turning to FIGS. 16A and 16B, an oral care implement 300 in accordance with a third embodiment of the present invention will be described. The oral care implement 300 is similar to the oral care implement 100 in many aspects, and therefore similar features will be similarly numbered except that the 300-series of numbers will be used. Furthermore, the specific structure of features of the oral care implement 300 that are similar to or the same as features of the oral care implement 100 will not be repeated in the interest of brevity. In FIGS. 16A and 16B, only a close-up view of the hinge section 350 of the oral care implement 300 is illustrated. It should be understood that all components and structures of the oral care implement 300 that are not illustrated are the same as or similar to components from either of the oral care implements 100, 200 previously described herein.

The oral care implement 300 comprises a first rigid longitudinal section 320, a second rigid longitudinal section 330 and a hinge section 350. The hinge 350 is formed by a bulbous body 324 formed at a proximal end 322 of the first rigid longitudinal section 320, a basin 334 formed at a proximal end 331 of the second rigid longitudinal section 330 and a flexible strut 340 that extends between the first and second rigid longitudinal sections 320, 330. The first rigid longitudinal section 320 is spaced from the second rigid longitudinal section 330 by a gap 326. Although not illustrated, the oral care implement 300 comprises a resilient material that fills in the gap 326 to provide a flexible connection between the first rigid longitudinal section 320 and the second rigid longitudinal section 330 about the hinge 350 as has been described herein above with regard to the oral care implements 100, 200.

The oral care implement 300 also comprises a flexure limiting block 306 to prevent overflexing of the second rigid longitudinal section 330 relative to the first rigid longitudinal section 320 about the hinge 350. However, the oral care implement 300 omits a second flexure limiting block and a transverse channel extending through the bulbous body, both of which were described herein above with regard to the oral care implement 100. Thus, the oral care implement 300 is similar to the oral care implement 100 with the exception that the oral care implement 300 omits the second flexure limiting block and the transverse channel. As a result of the omission of the aforementioned components, the oral care implement 300 is also devoid of an oblique (or second) strut that facilitates a subsequent pivoting motion as has been described herein above.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An oral care implement comprising:

a handle extending along a longitudinal axis and comprising a rigid gripping section, a rigid neck section, and a hinge flexibly connecting the rigid neck section to the rigid gripping section, wherein one of the rigid neck section or the rigid gripping section comprises a bulbous body and the other one of the rigid neck section or the rigid gripping section comprises a basin;

the hinge comprising:

the bulbous body;

the basin;

a longitudinal strut of rigid material, the longitudinal strut having a first end connected to a convex surface of the bulbous body and a second end connected to a floor of the basin so that a separation gap exists between the bulbous body and the floor of the basin; and a resilient material in the separation gap; and a head connected to the rigid neck section of the handle.

2. The oral care implement according to claim 1 wherein the rigid neck section pivots relative to the rigid gripping section about the hinge upon a force being applied to a front surface of the head.

3. The oral care implement according to claim 1 wherein the bulbous body forms a distal end of the rigid gripping section and the basin forms a proximal end of the rigid neck section.

4. The oral care implement according to claim 3 wherein the rigid gripping section comprises a first transverse shoulder comprising the bulbous body.

5. The oral care implement according to claim 1 wherein the longitudinal strut has a thickness measured from a front surface of the longitudinal strut to a rear surface of the longitudinal strut and a width measured from a first side surface of the longitudinal strut to a second side surface of the longitudinal strut, the width being greater than the thickness.

6. The oral care implement according to claim 5 wherein the longitudinal strut has a substantially rectangular transverse cross-sectional area.

7. The oral care implement according to claim 1 wherein the handle has a length ($L_H$) measured from a proximal end of the rigid gripping section to a distal end of the rigid neck section, the hinge located a distance ($D_H$) from the distal end of the rigid neck section, and wherein $D_H$ is less than 50% of $L_H$.

8. The oral care implement according to claim 7 wherein $D_H$ is between 20% to 35% of $L_H$.

9. The oral care implement according to claim 1 wherein the rigid neck section, the rigid gripping section and the longitudinal strut are integrally formed of the rigid material.

10. The oral care implement according to claim 1 wherein the bulbous body is a semi-spheroid.

11. The oral care implement according to claim 1 wherein the separation gap is an annular channel that circumferentially surrounds the longitudinal strut, the annular channel filled with the resilient material to encase the longitudinal strut.

12. The oral care implement according to claim 1 further comprising a transverse channel formed in a rear surface of the bulbous body.

13. The oral care implement according to claim 1 further comprising an axial groove in an outer surface of the rigid gripping section extending from the hinge toward a proximal end of the rigid gripping section, the resilient material filling the axial groove.

14. The oral care implement according to claim 1 wherein the resilient material is an injection molded thermoplastic elastomer and the rigid gripping section, the rigid neck section, and the longitudinal strut are constructed of a rigid plastic.

15. The oral care implement according to claim 1 wherein the longitudinal strut is substantially coaxial with the longitudinal axis.

16. The oral care implement according to claim 1 wherein the bulbous body and the floor of the basin are encased by the resilient material.

17. The oral care implement according to claim 1 wherein the head comprises a front surface, a rear surface and a plurality of tooth cleaning elements extending from the head, and wherein the basin forms a proximal end of the rigid neck section, the rigid neck section comprising first and second flanges that extend axially from the floor of the basin to form opposing sidewalls of the basin.

18. The oral care implement according to claim 17 wherein the first and second longitudinal flanges are circumferentially spaced apart from one another by a first valley circumferentially aligned with the rear surface of the head and a second valley circumferentially aligned with the front surface of the head.

19. The oral care implement according to claim 1 wherein the handle has a first transverse cross-sectional area taken at an axial location of the longitudinal strut and the longitudinal strut has a second transverse cross-sectional area taken at the axial location, wherein the second transverse cross-sectional area is in a range between 7% to 35% of the first transverse cross-sectional area.

20. The oral care implement according to claim 1 further comprising a first flexure limiting block protruding from a rear surface of the bulbous body and a second flexure limiting block protruding from the floor of the basin, the first and second flexure limiting blocks circumferentially aligned with one another and a rear surface of the head, a flexure limiting gap between the first and second flexure limiting blocks, the resilient material in the flexure limiting gap.

21. The oral care implement according to claim 20 wherein the hinge further comprises an oblique strut formed into the bulbous body, the longitudinal strut and the oblique strut arranged such that upon a force being applied to a front surface of the head, the rigid neck section: (1) initially pivots relative to the rigid gripping section about the longitudinal strut a first angle; and (2) subsequently pivots relative to the rigid gripping section about the oblique strut a second angle.

22. The oral care implement according to claim 21 wherein mechanical interference between the first and second flexure limiting blocks causes pivoting of the rigid neck section relative to the rigid gripping section to transition from the longitudinal strut to the oblique strut.

23. The oral care implement according to claim 21 wherein the longitudinal strut extends along a first axis and the oblique strut extends along a second axis, and wherein the longitudinal strut has a first transverse cross-sectional area taken along the first axis and the oblique strut has a second transverse cross-sectional area taken along the second axis, the second transverse cross-sectional area being greater than the first transverse cross-sectional area.

24. An oral care implement comprising:

a head; and a handle extending along a longitudinal axis and connected to the head, the handle comprising:

a main body integrally formed of a rigid material, the main body comprising a first rigid longitudinal section terminating in a bulbous body, a second rigid longitudinal section terminating in a basin, and a longitudinal strut having a first end connected to the bulbous body and a second end connected to a floor of the basin;

a resilient material encasing the longitudinal strut; and the longitudinal strut and the resilient material forming a hinge about which the second rigid longitudinal section pivots relative to the first rigid longitudinal section upon a force being applied to the head;

wherein the longitudinal strut axially extends from an apex of the bulbous body.

25. The oral care implement according to claim 24 wherein the basin is located at a proximal end of the second rigid longitudinal section and the head is connected to a distal end of the second rigid longitudinal section, and wherein the bulbous body is located at a distal end of the first rigid longitudinal section.

26. The oral care implement according to claim 24 wherein the bulbous body and the floor of the basin are separated by a separation gap that is filled with the resilient material.

27. The oral care implement according to claim 24 wherein the first rigid longitudinal section comprises a first transverse shoulder.

28. The oral care implement according to claim 24 wherein the longitudinal strut has a thickness measured from a front surface of the longitudinal strut to a rear surface of the longitudinal strut and a width measured from a first side surface of the longitudinal strut to a second side surface of the longitudinal strut, the width being greater than the thickness.

29. The oral care implement according to claim 28 wherein the longitudinal strut has a substantially rectangular transverse cross-sectional area.

30. The oral care implement according to claim 24 wherein the handle has a length ($L_H$) measured from a proximal end of the first rigid longitudinal section to a distal end of the second rigid longitudinal section, the hinge located a distance ($D_H$) from the distal end of the second rigid longitudinal section, and wherein $D_H$ is less than 50% of $L_H$.

31. The oral care implement according to claim 30 wherein $D_H$ is between 15% to 40% of $L_H$.

32. The oral care implement according to claim 24 wherein the head comprises a front surface, a rear surface and a plurality of tooth cleaning elements extending from the head, and wherein the second rigid longitudinal section comprises first and second flanges that extend axially from the floor of the basin in a circumferentially spaced apart manner so as to be separated by a first valley circumferentially aligned with the rear surface of the head and a second valley circumferentially aligned with the front surface of the head.

33. The oral care implement according to claim 32 wherein the first and second flanges flare radially outwardly from the longitudinal axis.

34. The oral care implement according to claim 24 wherein the hinge forms a bulbous thumb grip of the handle.

35. The oral care implement according to claim 24 wherein the bulbous body and the floor of the basin are encased by the resilient material.

36. The oral care implement according to claim 24 further comprising a first flexure limiting block protruding from a rear surface of the bulbous body and a second flexure limiting block protruding from the floor of the basin, the first and second flexure limiting blocks circumferentially aligned with one another and a rear surface of the head, a flexure limiting gap between the first and second flexure limiting blocks, the resilient material in the flexure limiting gap.

37. The oral care implement according to claim 36 wherein the hinge further comprises an oblique strut formed into the bulbous body, the longitudinal strut and the oblique strut arranged such that upon a force being applied to a front surface of the head, the second rigid longitudinal section: (1) initially pivots relative to the first rigid longitudinal section about the longitudinal strut a first angle; and (2) subsequently pivots relative to the first rigid longitudinal section about the oblique strut a second angle.

38. The oral care implement according to claim 37 wherein mechanical interference between the first and second flexure limiting blocks causes pivoting of the second rigid longitudinal section relative to the first rigid longitudinal section to transition from the longitudinal strut to the oblique strut.

39. The oral are implement according to claim 24 further comprising a transverse channel formed in a rear surface of the bulbous body.

40. An oral care implement comprising:

a head comprising a front surface and a rear surface;

a plurality of teeth cleaning elements extending from the head;

a handle connected to the head, the handle extending along a longitudinal axis and comprising a first rigid longitudinal section, a second rigid longitudinal section, and a hinge about which the second longitudinal section pivots relative to the first longitudinal section upon a force being applied to the head;

the hinge comprising:

a bulbous body of the first rigid longitudinal section;

a basin of the second rigid longitudinal section, the basin formed by first and second longitudinal flanges that extend axially from a floor of the basin, the first and second longitudinal flanges being circumferentially spaced apart from one another by a first valley circumferentially aligned with a rear surface of the head; and a resilient material in a separation gap between the bulbous body and the floor of the basin that connects the first and second rigid longitudinal sections together.

41. The oral care implement according to claim 40 wherein the hinge further comprises a longitudinal strut having a first end connected to the bulbous body and a second end connected to the floor of the basin.

42. The oral care implement according to claim 40 wherein the handle has a length ($L_H$) measured from a proximal end of the first rigid longitudinal section to a distal end of the second rigid longitudinal section, the hinge located a distance ($D_H$) from the distal end of the second rigid longitudinal section, and wherein $D_H$ is less than 50% of $L_H$.

43. The oral care implement according to claim 42 wherein $D_H$ is between 15% to 40% of $L_H$.

44. The oral care implement according to claim 40 wherein the first and second flanges flare radially outwardly from the longitudinal axis.

45. The oral care implement according to claim 40 wherein the first rigid longitudinal section is a gripping section of the handle and the second rigid longitudinal section is a neck section of the handle.

46. An oral care implement comprising:

a head;

a handle extending along a longitudinal axis and connected to the head, the handle comprising:

a main body integrally formed of a rigid material, the main body comprising a rigid gripping section terminating in a first transverse shoulder, a rigid neck section terminating in a second transverse shoulder, and a longitudinal strut having a first end connected to the first transverse shoulder and a second end connected to the second transverse shoulder;

a separation gap between the rigid gripping section and the rigid neck section;

a first flexure limiting block protruding from the first transverse shoulder into the separation gap;

a second flexure limiting block protruding from the second transverse shoulder into the separation gap, the first and second flexure limiting blocks circumferentially aligned with one another and a rear surface of the head so that a flexure limiting gap is formed between the first and second flexure limiting blocks; and a resilient material in the separation gap and in the flexure limiting gap; and the longitudinal strut and the resilient material forming a hinge about which the rigid neck section pivots relative to the rigid gripping section upon a force being applied to the head.

47. The oral care implement according to claim 46 wherein the main body comprises the first flexure limiting block and the second flexure limiting block.

48. The oral care implement according to claim 46 wherein the first and second transverse shoulders are separated by a flexure facilitating gap located adjacent a front surface of the longitudinal strut, the flexure limiting gap located adjacent a rear surface of the longitudinal strut, and wherein the flexure facilitating gap has a first width and the flexure limiting gap has a second width that is less than the first width.

49. The oral care implement according to claim 48 wherein a ratio of the second width to the first width is in a range of 0.1 to 0.6.

50. The oral care implement according to claim 46 wherein mechanical interference between the first and second flexure limiting blocks limits pivoting of the rigid neck section relative to the rigid gripping section in a counter-clockwise direction, a rear surface of the head facing the counter-clockwise direction.

51. The oral care implement according to claim 50 wherein the mechanical interference between the first and second flexure limiting blocks limits pivoting of the rigid neck section relative to the rigid gripping section in the counter-clockwise direction to a first angle that prevents permanent deformation or breakage of the longitudinal strut.

52. The oral care implement according to claim 51 wherein the first angle is less than or equal to about 25 degrees.

53. The oral care implement according to claim 46 wherein the longitudinal strut and the first and second flexure limiting blocks are encased in the resilient material.

54. The oral care implement according to claim 46 wherein the second flexure limiting block is connected to the second transverse shoulder and a rear surface of the longitudinal strut.

55. The oral care implement according to claim 46 wherein the first transverse shoulder comprises a convex surface, the first flexure limiting block connected to and protruding from the convex surface.

56. The oral care implement according to claim 46 wherein the first and second flexure limiting blocks comprise a substantially rectangular shape.

57. The oral care implement according to claim 46 wherein the main body further comprises an oblique strut formed into the first transverse shoulder, the oblique strut forming part of the hinge.

58. The oral care implement according to claim 57 wherein the longitudinal strut and the oblique strut are arranged such that upon the brushing force being applied to the head, the rigid neck section: (1) initially pivots relative to the rigid gripping section about the longitudinal strut a first angle; and (2) subsequently pivots relative to the rigid gripping section about the oblique strut a second angle.

59. The oral care implement according to claim 57 wherein the first transverse shoulder comprises a bulbous body, a transverse channel being formed into a rear surface of the bulbous body to form the oblique strut.

60. An oral care implement comprising:

a head having a front surface and an opposing rear surface, a plurality of cleaning elements extending from the front surface of the head;

a handle extending along a longitudinal axis and connected to the head, the handle comprising:

a main body integrally formed of a rigid material, the main body comprising a rigid gripping section terminating in a first transverse shoulder, a rigid neck section terminating in a second transverse shoulder, a first strut, a second strut oriented obliquely to the first strut, and a flexure limiting block;

a separation gap between the rigid neck section and the rigid gripping section;

a resilient material in the separation gap; and the first strut, the second strut, and the resilient material forming a hinge pivotably coupling the rigid neck section and the rigid gripping section together, the flexure limiting block limiting deflection of the rigid neck section in response to a force applied to the front surface of the head.

61. The oral care implement according to claim 60 wherein the first strut and the second strut connect the rigid neck section and the rigid gripping section such that upon the force being applied to the front surface of the head, the rigid neck section: (1) initially pivots relative to the rigid gripping section about the first strut a first angle; and (2) subsequently pivots relative to the rigid gripping section about the second strut a second angle.

62. The oral care implement according to claim 61 wherein the flexure limiting block is a first flexure limiting block protruding from the first transverse shoulder and further comprising a second flexure limiting block protruding from the second transverse shoulder, the first and second flexure limiting blocks circumferentially aligned with one another and the rear surface of the head, a flexure limiting gap between the first and second flexure limiting blocks, the resilient material in the flexure limiting gap.

63. The oral care implement according to claim 62 wherein mechanical interference between the first and second flexure limiting blocks causes pivoting of the rigid neck section relative to the rigid gripping section to transition from the first strut to the second strut.

64. The oral care implement according to claim 63 wherein the mechanical interference between the first and second flexure limiting blocks limits pivoting of the rigid neck section relative to the rigid gripping section in a counter-clockwise direction to the first angle so as to prevent permanent deformation or breakage of the first strut.

65. The oral care implement according to claim 64 wherein the first angle is less than or equal to about 25 degrees.

66. The oral care implement according to claim 60 wherein the first transverse shoulder comprises a bulbous body, a transverse channel being formed into a rear surface of the bulbous body to form the second strut.

67. The oral care implement according to claim 60 wherein the first strut extends along a first axis and the second strut extends along a second axis, and wherein the first strut has a first transverse cross-sectional area taken along the first axis and the second strut has a second transverse cross-sectional area taken along the second axis, the second transverse cross-sectional area being greater than the first transverse cross-sectional area.

68. The oral care implement according to claim 67 wherein the first axis and the second axis intersect at an oblique angle.

69. The oral care implement according to claim 60 wherein the first strut and the second strut connect the rigid neck section and the rigid gripping section such that: (1) a first torque is required to pivot the rigid neck section relative to the rigid gripping section about the first strut a first angle; and (2) a second torque is required to subsequently pivot the rigid neck section relative to the rigid gripping section about the second strut a second angle, wherein the second torque is greater than the first torque.

* * * * *